US009453694B1

(12) United States Patent
Storch

(10) Patent No.: US 9,453,694 B1
(45) **Date of Patent: *Sep. 27, 2016**

(54) FIREARM HAND GUARD MOUNTING ASSEMBLY

(71) Applicant: Midwest Industries, Inc., Waukesha, WI (US)

(72) Inventor: Troy Storch, Wales, WI (US)

(73) Assignee: Midwest Industries, Inc., Waukesha, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/960,813

(22) Filed: Dec. 7, 2015

Related U.S. Application Data

(62) Division of application No. 14/667,922, filed on Mar. 25, 2015.

(51) Int. Cl.

| | |
|---|---|
| ***F41C 23/16*** | (2006.01) |
| ***F41A 3/64*** | (2006.01) |
| ***F41A 3/66*** | (2006.01) |
| ***F41A 35/00*** | (2006.01) |

(52) U.S. Cl.
CPC .. *F41A 3/64* (2013.01); *F41A 3/66* (2013.01); *F41A 35/00* (2013.01); *F41C 23/16* (2013.01)

(58) Field of Classification Search
CPC ..... F41C 23/16; F41C 23/00; F41C 27/00; F41A 11/02; F41A 3/66; F41A 35/00
USPC ..... 42/75.01–75.04, 71.01, 72, 73
See application file for complete search history.

(56) References Cited

U.S. PATENT DOCUMENTS

| | | | | |
|---|---|---|---|---|
| 8,769,854 | B1 * | 7/2014 | Battaglia | F41A 3/66 42/71.01 |
| 9,091,505 | B1 * | 7/2015 | Battaglia | F41C 23/20 |
| 2008/0092422 | A1 * | 4/2008 | Daniel | F41C 23/16 42/90 |
| 2013/0219765 | A1 * | 8/2013 | Ibarguren | F41A 21/485 42/75.02 |
| 2014/0130390 | A1 * | 5/2014 | Geissele | F41C 23/16 42/71.01 |
| 2014/0373419 | A1 * | 12/2014 | Leclair | F41C 23/16 42/71.01 |
| 2015/0369555 | A1 * | 12/2015 | Daniel | F41A 21/48 42/75.02 |

* cited by examiner

*Primary Examiner* — Joshua Freeman
(74) *Attorney, Agent, or Firm* — Boyle Fredrickson, S.C.

(57) ABSTRACT

A hand guard mount assembly and method of securing a hand guard to a firearm in a manner that resists rotation and/or longitudinal translation of the hand guard relative to the underlying firearm. The hand guard mount assembly includes a mount clip that is defined by a body having a first portion and a second portion. The first portion of the clip is constructed to be received in a slot defined by a hand guard and defines a smallest diameter associated with a receiver end of the hand guard. The second portion of the clip radially and/or longitudinally indexes the mount clip, and a hand guard associated therewith, relative to at least one of a barrel nut, a barrel, and a receiver associated with the underlying firearm.

23 Claims, 23 Drawing Sheets

FIREARM HAND GUARD MOUNTING ASSEMBLY

CROSS-REFERENCE TO RELATED APPLICATIONS

This application is a Continuation-In-Part of U.S. patent application Ser. No. 14/667,922 filed on Mar. 25, 2015 titled "Firearm Hand Guard Mounting Assembly" and the disclosure of which is expressly incorporated herein.

BACKGROUND OF THE INVENTION

The present invention relates generally to mounting arrangements associated with securing a hand guard to an underlying firearm assembly. More specifically, the present invention relates to a mount clip, and methods for securing a hand guard to a firearm that defines the compression associated with a compression slot associated with the hand guard. In another aspect, the present invention is directed to a mounting arrangement that prevents rotation and/or longitudinal translation of the hand guard relative to the underlying firearm when the hand guard is secured thereto.

Many firearms, particularly when provided as a rifle or tactical firearm configuration, are provided with a hand guard that extends in a longitudinal direction along at least a rearward portion of a barrel of a respective firearm. A forward facing end of the hand guard is commonly supported by the barrel and a rearward facing end of the hand guard is commonly supported by the barrel and/or the receiver. An outwardly directed surface of the hand guard is frequently configured to accommodate securing of various accessories and/or attachments to the underlying firearm. A substantial portion of the hand guard is also commonly spaced from the barrel to prevent the user from direct contact with the barrel and to mitigate thermal exchange between the barrel and the hand guard as the barrel may become hot during use of the underlying firearm.

Many hand guards provide accessory mounting arrangements, such as the widely used picatinny rail for example, which is commonly identified as a MIL-STD-1913 rail, STANAG 2324 rail, or tactical rail, and provide one heavily accepted standardized platform for attaching auxiliary devices or accessories to a firearm. Such accessories can include sights, telescopic sights, magnifiers, lights, night vision devices, ammunition clips, auxiliary supports such as bipods and/or tripods, for example. Such accessory rails are commonly secured to a firearm to provide a platform that allows the user to easily modify a firearm configuration by quickly attaching and/or detaching desired accessories to and from the projections associated with the respective rails to achieve a desired configuration of the firearm. Many such accessories are configured to tool-lessly cooperate with the underlying rail to improve the efficiency with which the desired accessories can be associated with the underlying firearm. Particularly with sighting accessories, accurate use of the firearm requires repeatable positioning of the respective accessories relative to the underlying firearm. The accuracy associated with use of the firearm, and particularly use of the firearm with hand guard supporting sighting accessories, can be detrimentally affected if the hand guard should become loose or otherwise movable, even slightly, relative the underlying firearm. Said in another way, providing a mechanically and physically secure mounting arrangement with which a hand guard can be secured to an underlying firearm ensures repeatable desired use of the underlying firearm with any accessories that are supported by a hand guard.

A receiver facing end of many hand guards is commonly supported by a mount body or structure that is disposed between the hand guard and the barrel and/or a forward facing end of the receiver. The mount structure is commonly integrally formed by one of the barrel, a barrel nut, and/or the receiver and is commonly constructed to directly engage the hand guard when the hand guard is secured to the underlying firearm. Frequently, the rearward or receiver facing portion of the hand guard includes a clamp or compression slot and is configured to cooperate with one or more fasteners. Tightening of the fasteners when the hand guard is associated with an underlying firearm manipulates a physical shape of the hand guard and compresses a portion of the hand guard about a mating mounting structure defined by the barrel, barrel nut, and/or the receiver of the underlying firearm. Unfortunately, many known mounting arrangements are susceptible to various undesirable operations which can damage one or more of the structures associated with securing the rearward facing end of the hand guard relative to a firearm.

For instance, over-tightening of one or more fasteners associated with securing the hand guard to the firearm can result in damage to one or more of the hand guard, and commonly the threaded openings configured to cooperate with the fasteners, the fasteners themselves, the mating features associated with the contacting interfaces between the hand guard and the receiver and/or barrel or barrel nut, and/or deform or undesirably stress the structure of the hand guard. Commonly, the securing arrangement is provided as a compression arrangement that relies on the surface friction between the overlapping mating structures of the hand guard and the receiver, barrel nut, and/or barrel to maintain the desired orientation of the hand guard relative to the underlying firearm. Undesirable or unexpected loosening of the fasteners, unobserved debris associated with the attaining the initial interface, different rates of thermal expansion and contraction, as well as various other factors can detract from the ability to acquire and maintain a desired secure physical interaction between the hand guard and the underling barrel, barrel nut, and/or receiver.

Once assembled, small and sometimes imperceptible translations of the hand guard relative to the underlying firearm can detrimentally impact use of the underlying firearm. For instance, if sighting devices are supported by the hand guard, any movement of the hand guard relative to the underlying firearm can result in unacceptable inaccuracy associated with use of the firearm. When provided as a compression interface, the interface between the hand guard and firearm assembly associated with many hand guard mounting methodologies allows initial relative translation between the hand guard and the underlying firearm in both an axial direction or a direction generally aligned with the bore of the firearm, and a rotational direction relative to an axis commonly aligned with the bore. Ensuring accurate and repeatable use of the underlying firearm with respect to any accessories supported by the hand guard requires a secure mechanical connection therebetween and a connection that mitigates deformation of the structures associated with securing the hand guard to the underlying firearm. Arguably, although rotational translation of the hand guard relative to the underlying firearm can have a greater detrimental impact on repeatable and accurate use of the underlying firearm than true axial displacement of the hand guard relative to the receiver due to misalignments associated with sighting devices supported by the hand guard, any translation between the hand guard and the underlying firearm after assembly is undesired.

Therefore, there is a need for a firearm hand guard mounting arrangement that prevents over compression between the interfacing structures of the hand guard and the underlying barrel, barrel nut, and/or receiver to mitigate instances of over-tightening of the fasteners associated with securing the hand guard to the underlying firearm. There is a further need for a firearm hand guard mounting arrangement that prevents rotation and/or longitudinal translation of the band guard relative to the underlying firearm once assembled.

SUMMARY OF THE INVENTION

The present invention provides a firearm hand guard mount assembly, arrangement, or system, and method of forming a hand guard mounting assembly, that overcomes one of more the aforementioned drawbacks. One aspect of the invention discloses a system and method for securing a hand guard to a receiver of a firearm. The mount assembly includes a mount clip that is defined by a body having a first portion and a second portion. The first portion of the mount clip is configured to be received in a slot defined by hand guard so as to define a smallest diameter associated with a receiver end of the hand guard. The second portion of the mount clip radially indexes the mount clip and a hand guard associated therewith relative to a receiver associated with the underlying firearm so as to prevent rotation of the hand guard relative to the receiver when assembled.

Another aspect of the invention that is useable or combinable with one or more of the above aspects or features discloses a mount clip that is defined by a body that includes a first portion constructed to be received in a slot defined by a hand guard and define a smallest diameter associated with a receiver end of a hand guard and a second portion that is constructed to radially index the mount clip and a hand guard relative to a receiver.

A further aspect of the invention that is useable or combinable with one or more of the above aspects or features discloses a firearm assembly that includes a barrel and a receiver constructed to support the barrel. The firearm assembly includes a hand guard that extends longitudinally along a portion of the barrel. The hand guard includes a rearward facing end portion that is constructed to be compressed about a portion of one of the barrel or the receiver to secure the rearward facing end of the hand guard relative to a firearm. The assembly includes a clip that is configured to cooperate with the hand guard and define a preset compression associated with the rearward facing end portion of the hand guard when it is secured to one of the barrel or the receiver.

Another aspect of the invention that is useable or combinable with one or more of the above aspects or features discloses a method of forming a firearm hand guard mounting assembly for securing a hand guard that has at least one compression slot formed in a receiver facing end of the firearm hand guard. A clip is provided that is configured to cooperate with a compression slot defined by a receiver facing end of a hand guard. A portion of the clip has a thickness that defines a maximum deflection of the compression slot when the hand guard is secured to a firearm.

A further aspect of the invention that is useable or combinable with one or more of the above aspects or features discloses a firearm hand guard mount assembly that includes a mount clip that is defined by a body that includes a first portion that is constructed to be received in a slot defined by a hand guard and define a smallest diameter associated with a receiver end of a hand guard and a second portion that is constructed to longitudinally index the mount clip and a hand guard relative to at least one of a barrel, a barrel nut, and a receiver.

Another aspect of the invention that is useable or combinable with one or more of the above aspects or features discloses a firearm assembly that includes a barrel, a receiver constructed to support the barrel, and a hand guard. The hand guard extends longitudinally along a portion of the barrel and includes a rearward facing end portion that is constructed to be compressed about a portion of one of the barrel or the receiver to secure the rearward facing end of the hand guard relative to a firearm. The assembly includes a clip that is configured to cooperate with at least one of the barrel, a barrel nut, the receiver and the hand guard and define a preset compression associated with the rearward facing end portion of the hand guard when it is secured to one of the barrel, the barrel nut, or the receiver.

Another aspect of the invention that is useable or combinable with one or more of the above aspects or features discloses a method of securing a hand guard to a firearm wherein the method includes positioning a firearm hand guard and a torsion clip relative to a firearm receiver such that a first portion of the torsion clip interferingly cooperates with at least one of the firearm receiver, a barrel of the firearm, and a barrel nut associated with securing the barrel to the firearm and tightening at least one fastener that extends across a compression slot defined by a receiver facing end of the hand guard such that a second portion of the torsion clip defines a maximum deflection of the compression slot of the hand guard.

A further aspect of the invention that is usable or combinable with one or more of the features or aspects above discloses a firearm barrel nut that includes a body that defines a bore configured to cooperate with a barrel of a firearm. The body of the barrel nut is further defined as extending between a first end of the body that is configured to be oriented nearer a muzzle of a barrel and a second end of the body that is constructed to cooperate with a receiver. The body of the barrel nut further includes at least one of a projection and a recess that is formed in an exterior surface of the body and configured to cooperate with a mount clip constructed to cooperate with a hand guard.

These and other aspects, features, and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Figure 1:
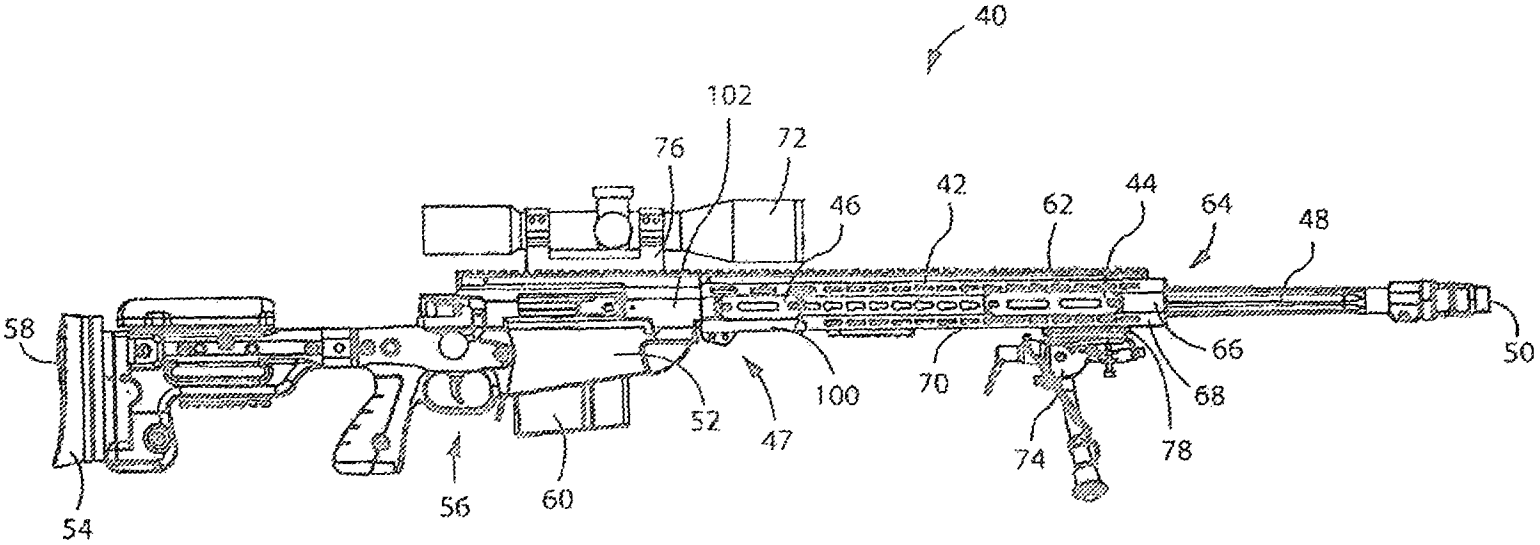
FIG. 1 is a side elevation view of an exemplary firearm equipped with a hand guard mounting assembly according to one embodiment of the present invention.
Figure 2:
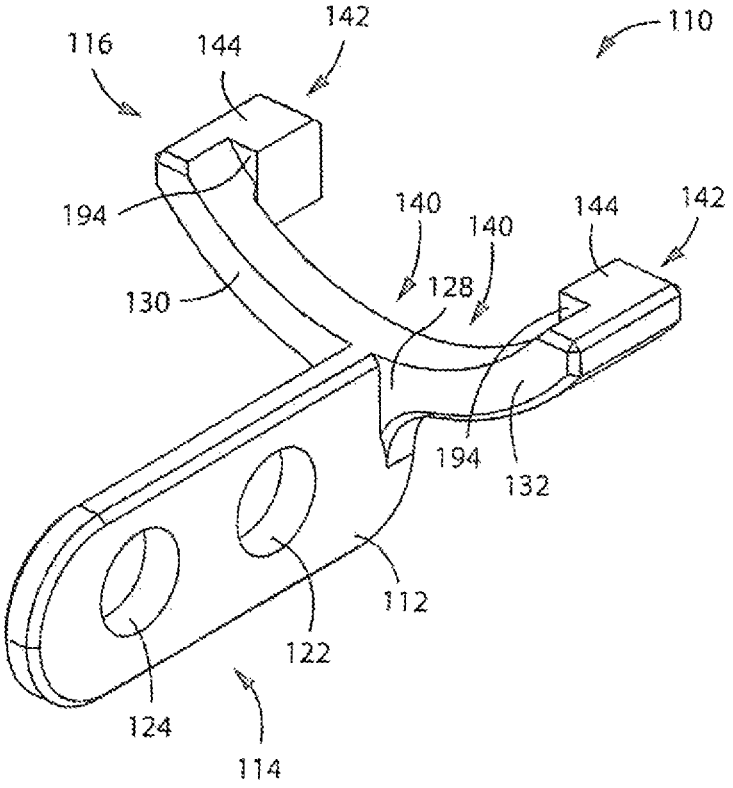
FIG. 2 is a perspective view of a mount clip of the hand guard mounting assembly shown in FIG. 1.
Figure 3:
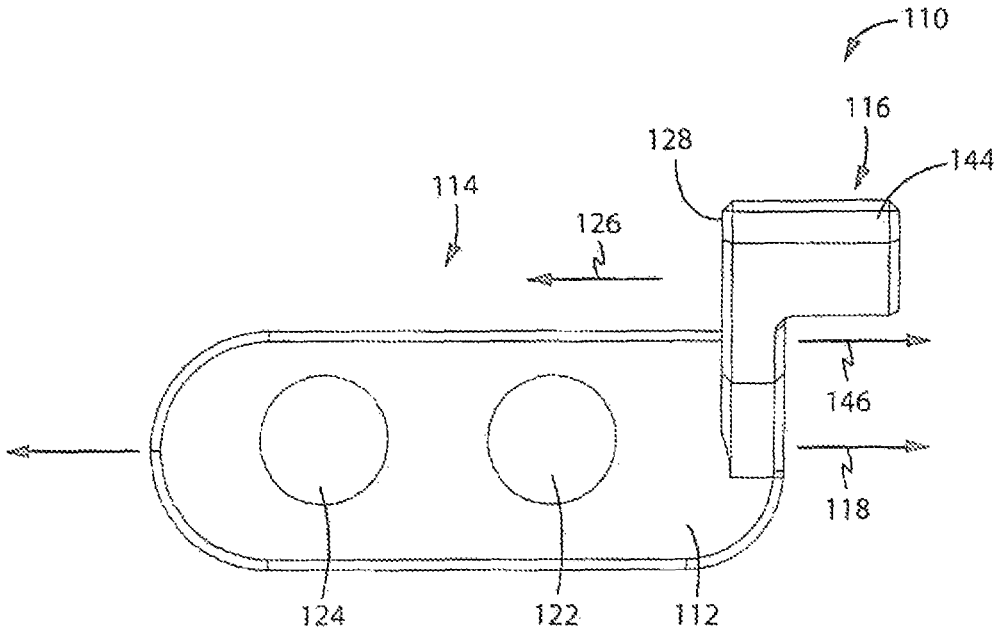
FIG. 3 is a side elevation view of the mount clip shown in FIG. 2.
Figure 4:
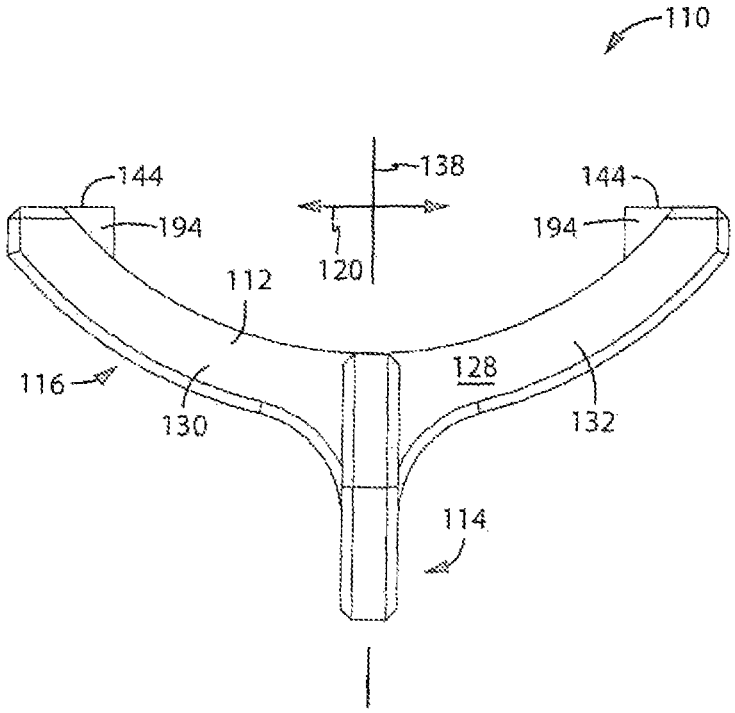
FIG. 4 is a front elevation view of the mount clip shown in FIG. 2.
Figure 5:
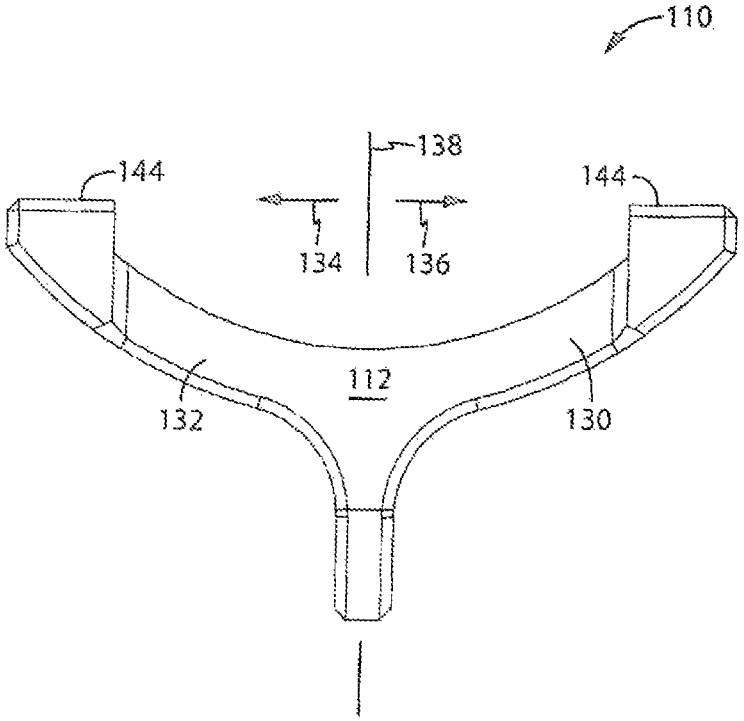
FIG. 5 is a rear elevation view of the mount clip shown in FIG. 2.
Figure 6:
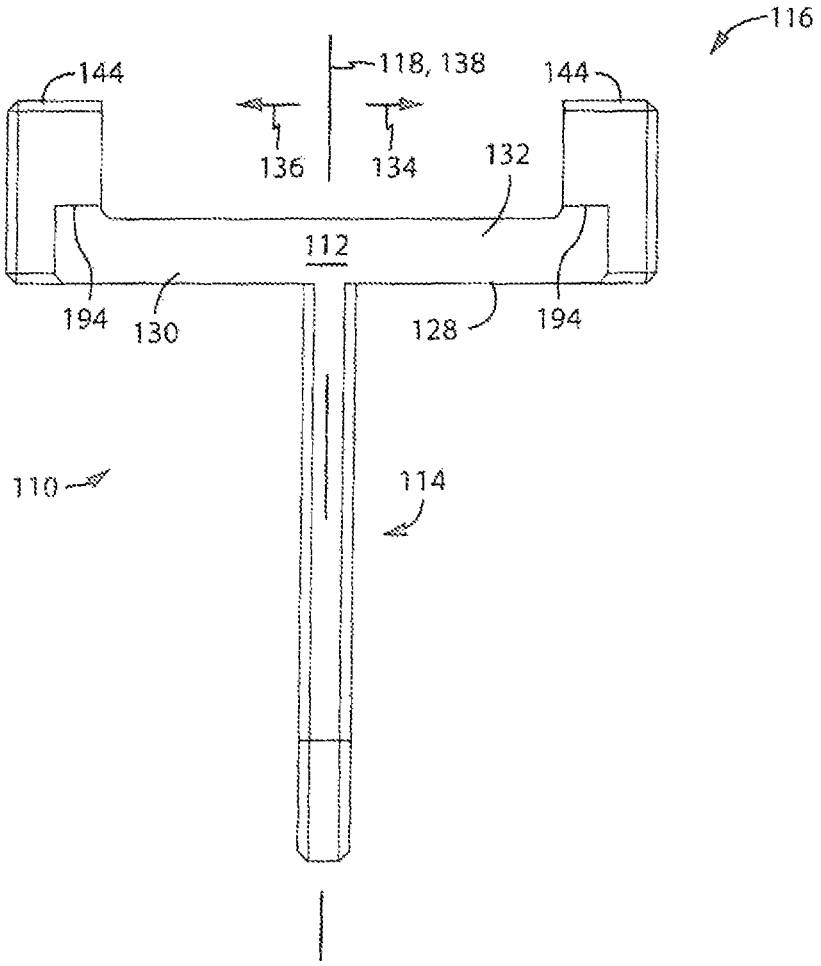
FIG. 6 is a top plan view of the mount clip shown in FIG. 2.
Figure 7:
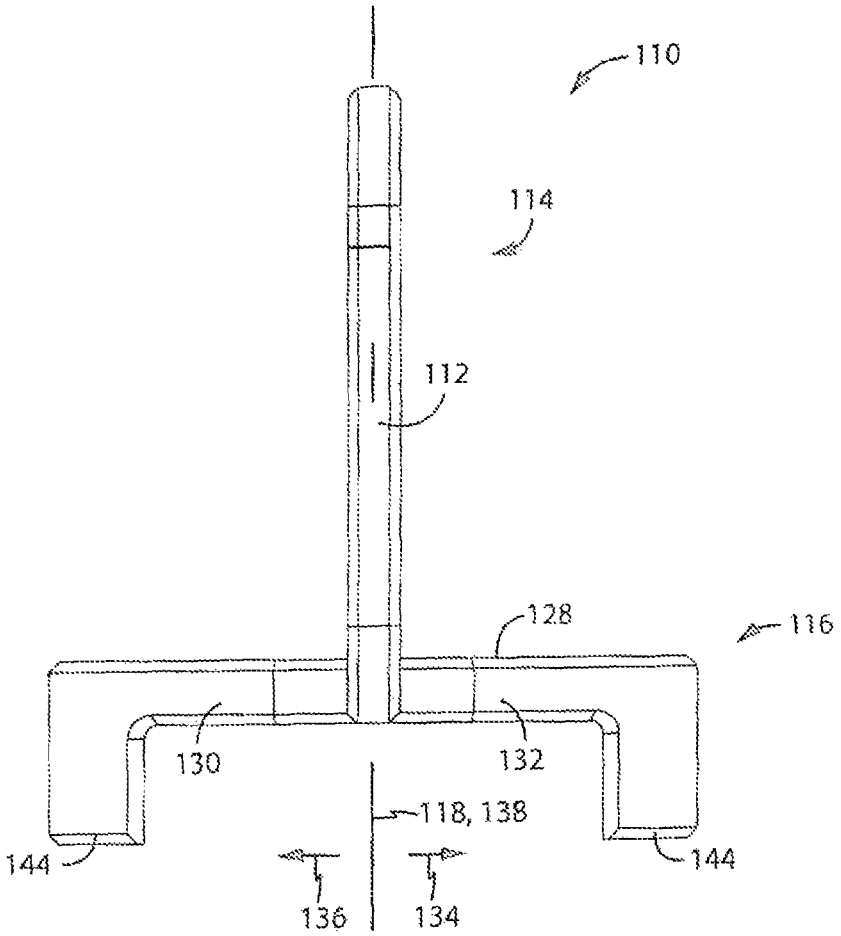
FIG. 7 is a bottom plan view of the mount clip shown in FIG. 2.

FIG. 1 shows a firearm 40 equipped with an exemplary hand guard 42, having various optional accessory mount adapters 44, 46, wherein the receiver facing end of the hand guard 42 is secured to the underlying firearm by a mount or mounting arrangement 47 according to the present invention. Firearm 40 includes a barrel 48 that extends between a muzzle 50 and a receiver 52. A stock 54 extends generally rearward of receiver 52. Receiver 52 supports a trigger assembly 56 such that trigger assembly 56 is disposed between a butt 58 defined by stock 54 of firearm 40 and barrel 48. Firearm 40 includes a magazine 60 associated with accommodating various rounds of ammunition. As is commonly understood, user interaction with trigger assembly 56 is associated with discharging firearm 40.

Hand guard 42 extends along barrel 48 generally forward of receiver 52 and includes one or more rows of engagement interfaces 62, 64, 66, 68, 70 associated with securing accessories to firearm 40. One or more accessories 72, 74, such as a scope 72 and a hi-pod 74, are associated with a respective accessory mount devices 76, 78 that is disposed between the respective accessory 72, 74 and the underlying accessory engagement interface 62, 64, 66, 68, 70. Each accessory mount device 76, 78 is constructed to securely cooperate with a respective engagement interface 62, 64, 66, 68, 70 associated with the underlying hand guard 42.

Although shown as a scope and a hi-pod, it is appreciated that various accessories, such as lights, other sighting devices, supplemental munitions, etc., can be supported hand guard 42 provided the respective accessories are configured to cooperate with or be secured to a respective engagement interface 62, 64, 66, 68, 70 defined by hand guard 42 and/or an optional adapter 44, 46. It is further appreciated that the rotational and longitudinal position of the desired accessories can be manipulated relative to hand guard 42 provided the desired engagement interface 62, 64, 66, 68, 70 defined by hand guard 42 is configured to cooperate with the accessory mount device 76, 78 associated with the underlying accessory. Maintaining a desired orientation of the respective accessories relative to the underlying firearm, when assembled and when one or more accessories are associated therewith, requires a robust and secure arrangement associated with securing hand guard 42 to the underlying firearm 40. Mounting arrangement 47 secures a receiver facing end 100 of hand guard 42 to a forward facing end 102 of receiver 52 in manner that maintains both the desired longitudinal or axial as well as rotational orientation of hand guard 42 relative to the underlying firearm 40 and prevents over compression of mounting arrangement associated with securing the hand guard 42 to the underlying firearm when assembled.

Referring to FIGS. 2-7, mounting arrangement 47 includes a mounting clip or mount clip 110 that is constructed to cooperate with hand guard 42 and receiver 52 to secure receiver facing end 100 of hand guard 42 relative to receiver 52. Mount clip 110 is defined by a body 112 that defines a first portion 114 and a second portion 116 of mount clip 110. First portion 114 and second portion 116 are oriented to extend in generally transverse directions relative to one another. Although various shapes and constructions are envisioned for accomplishing the benefits discussed further below, second portion 116 of mount dip 110 extends from first portion 114 proximate a respective end thereof and first portion 114 intersects second portion 116 proximate a middle portion thereof.

As shown, first portion 114 of mount clip 110 extends in a longitudinal direction, indicated by line 118 (FIG. 3), whereas second portion 116 extends in a crossing or transverse direction, indicated by line 120 (FIG. 4), and a somewhat upward incline relative to longitudinal direction 118. First portion 114 includes a first opening 122 and the second opening 124 that are offset from one another or spaced from one another relative to longitudinal axis 118. Openings 122, 124 are offset in a muzzle facing direction, indicated by line 126, relative to a forward facing surface 128 of second portion 116 of mount clip 110. As disclosed further below, openings 122, 124 are positioned and constructed to accommodate passage of respective fasteners through first portion 114 of mount clip 110 when hand guard 41 is secured to the underlying firearm 40. It is appreciated that other numbers and arrangements associated with openings 122, 124 are envisioned.

Second portion 116 of mount clip 110 includes a first ear or arm 130 and a second ear or arm 132 that extend in opposite respective lateral directions 134, 136 relative to a medial geometric plane 138 that bifurcates first portion 114 and contains longitudinal axis 118. As shown in FIGS. 4-7, it should be appreciated that the opposite lateral sides of mount clip 110 are generally mirror images of one another relative to plane 138. Each arm 130, 132 includes a laterally inboard end 140 approximate the intersection of first portion 114 and second portion 116 of mount clip 110 and a lateral outboard end 142 that is offset from plane 138. Each lateral outboard end 142 of each arm 130, 132 includes a projection 144 that extends in a generally rearward direction, indicated by arrow 146, generally aligned with but offset from longitudinal axis 118. As explained further below with respect to FIGS. 8-11 and 14, projections 144 are each constructed to cooperate with a respective pocket or cavity defined by receiver 52. The cooperation between projections 144 and the respective cavities mitigates rotation of mount clip 110 relative receiver 52, and thereby rotation of a hand guard associated therewith, when firearm 40 is assembled.

Figure 8:
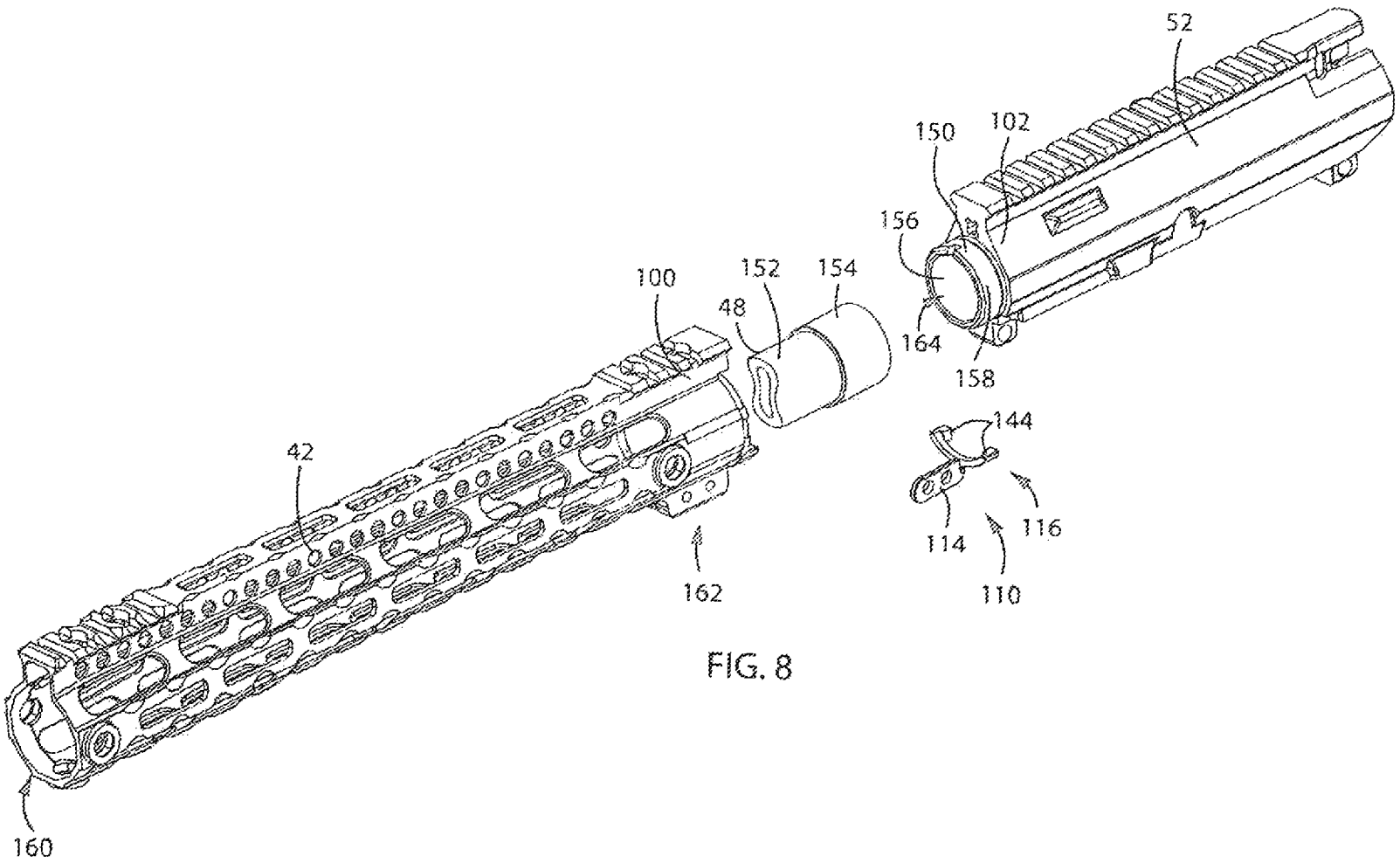
FIG. 8 is a partial exploded perspective view of a portion of a firearm assembly shown in FIG. 1.
Figure 9:
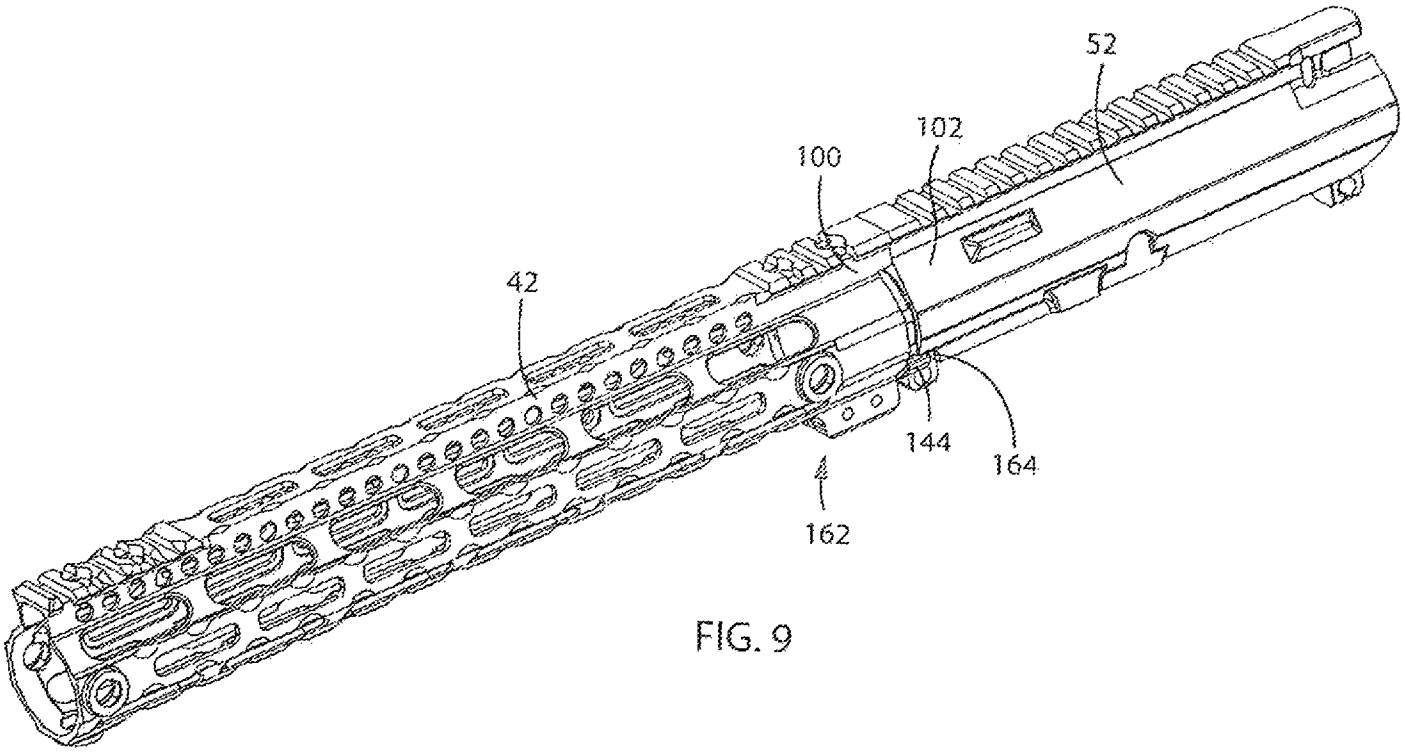
FIG. 9 is a partial perspective assembled view of the hand guard and receiver portion of the firearm shown in FIG. 8 with the barrel omitted therefrom.
Figure 10:
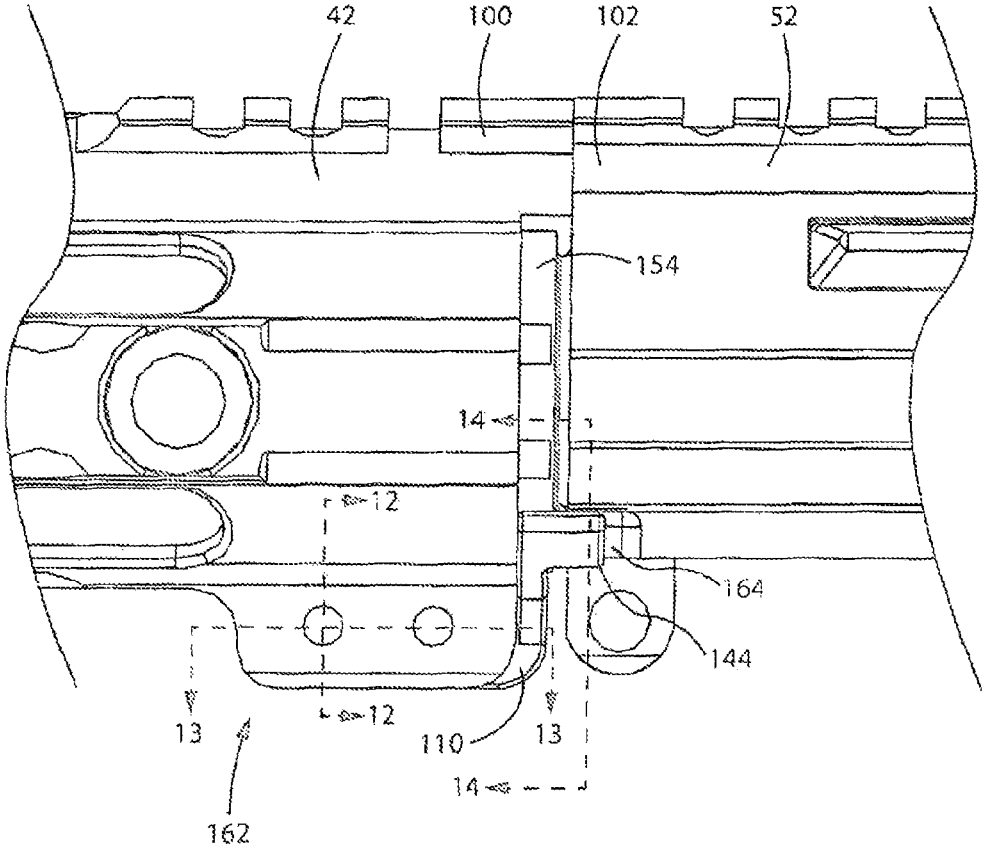
FIG. 10 is a side elevation view of a portion of the assembly shown in FIG. 9.
Figure 11:
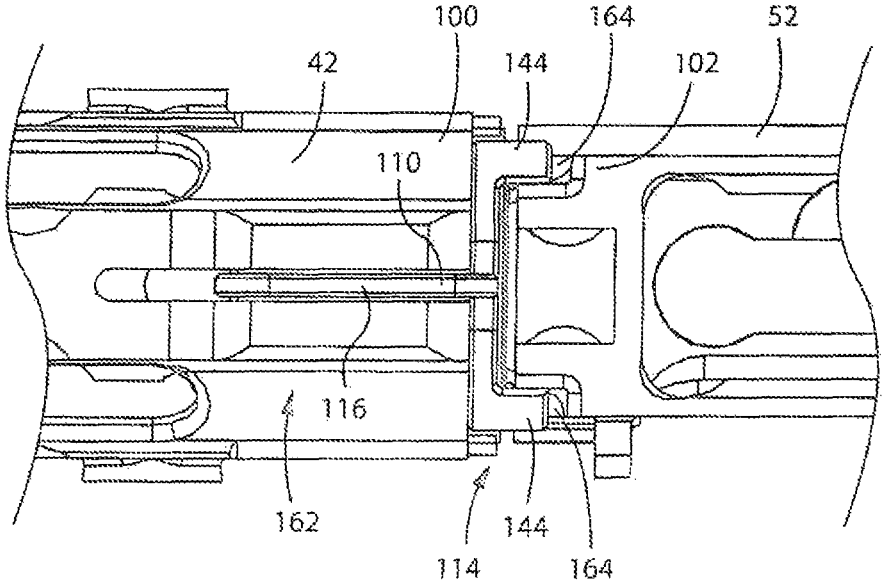
FIG. 11 is a bottom plan view of the portion of the assembly shown in FIG. 9.

FIG. 8 shows an exploded view of a portion of firearm 40 whereas FIGS. 9-11 show various views of a loosely assembled hand guard 42, mount clip 110, and receiver 52 assembly associated with firearm 40. Referring to FIGS. 8-11, forward facing end 102 of receiver 52 includes a barrel mounting structure 150 that is preferably constructed to removably cooperate with a receiver facing end 152 of barrel 48. A barrel nut 154 cooperates with barrel 48 and barrel mounting structure 150 to selectively secure receiver facing end 152 of barrel 48 to barrel mounting structure 150 associated with receiver 52. It should be appreciated that barrel mounting structure 150 associated with receiver 52 and barrel nut 154 are shown graphically as a number of different mounting interface methodologies are commonly provided therebetween. For instance, receiver facing end 152 of barrel 48 or barrel nut 154 can be constructed to rotationally cooperate with an interior surface 156 or an exterior surface 158 associated with barrel mounting structure 150 of receiver 52. It is further appreciated that receiver facing end 152 of barrel 48 can be constructed to slideably cooperate with interior surface 156 associated with forward facing end 102 of receiver 52, such that engagement of barrel nut with barrel mounting structure 150 of receiver 52 secures barrel 48 relative thereto. It is further appreciated that the receiver facing end 152 of barrel 48 may be constructed to directly cooperate with barrel mounting structure 150 to secure barrel 48 relative to receiver 52.

Barrel 48 extends longitudinally, and in a generally radially spaced associated, through a cavity 160 defined by hand guard 42. Receiver facing end 100 of hand guard 42 includes or is constructed to define a clamp, clamp assembly, or clamp body 162 associated with securing receiver facing end 100 of hand guard 42 relative to forward facing end 102 of receiver 52. As disclosed further below, first portion 114 of mount clip 110 is constructed to cooperate with clamp body 162 so as to define the maximum compression force associated with securing hand guard 42 to receiver 52. When assembled, projections 144 of mount clip 110 are constructed and oriented to be disposed in cavities 164 that are disposed toward opposite lateral sides proximate forward facing end 102 of receiver 52. As disclosed further below, the cooperation of projections 144 with respective cavities 164 act to further prevent rotational, translation of hand guard 42 relative to receiver 52.

Figure 12:
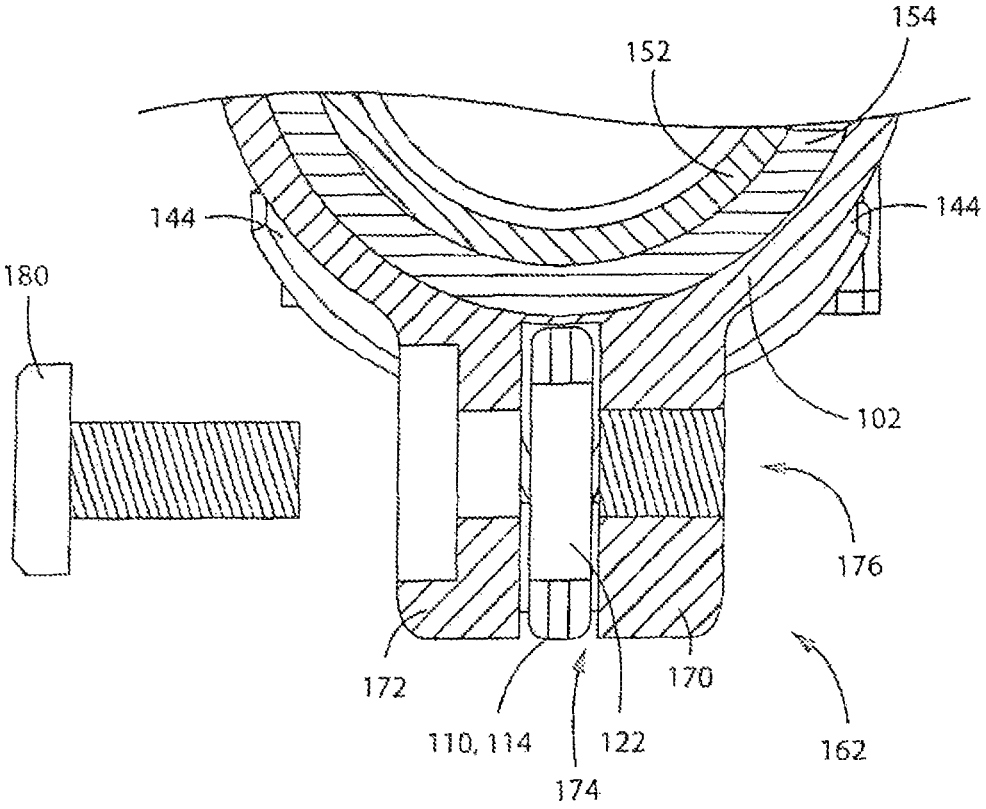
FIG. 12 a cross-section elevation view of a portion of the assembly shown in FIG. 9 taken along line 12-12 shown in FIG. 10.
Figure 13:
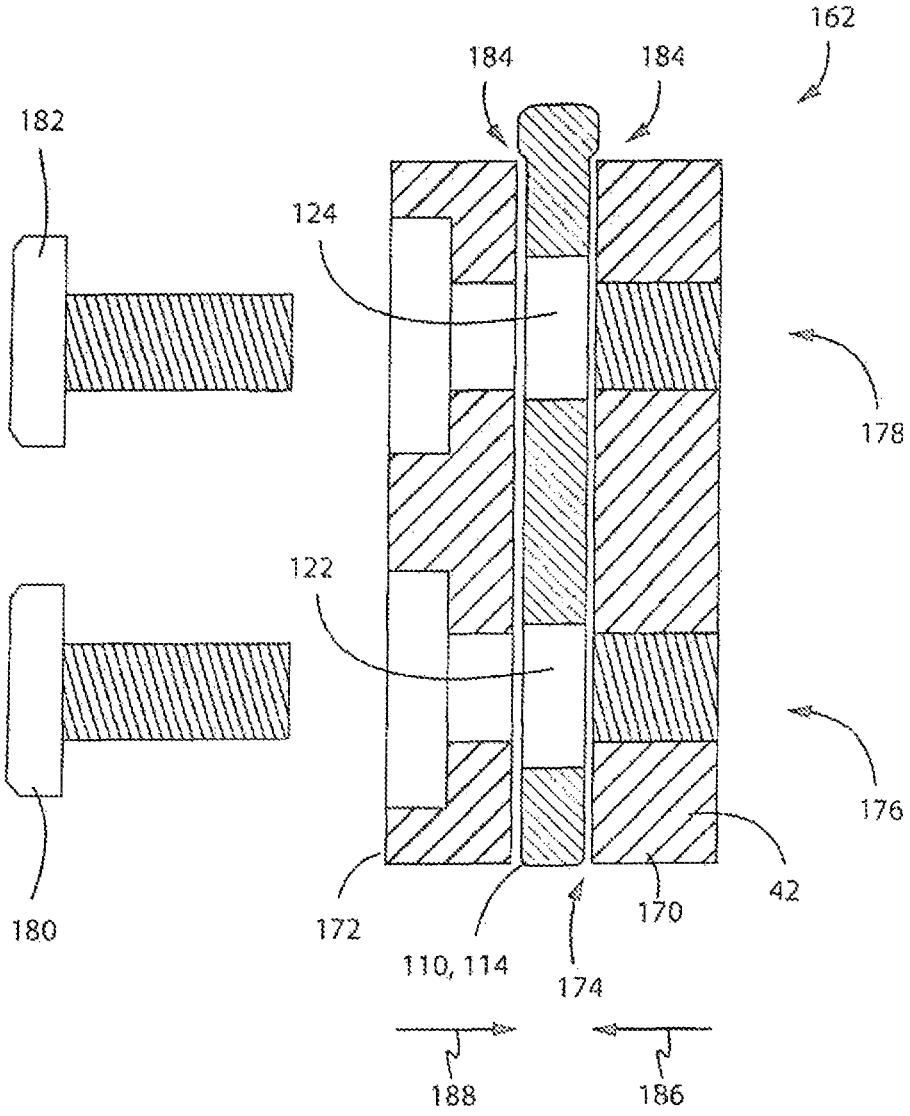
FIG. 13 is a cross-section elevation view of a portion of the assembly shown in FIG. 9 taken along line 13-13 shown in FIG. 10.

Referring to FIGS. 12 and 13, clamp body 162 defined by hand guard 42 includes a first portion 170 and a second portion 172 that extend along opposite longitudinal sides of a compression gap or slot 174 that is shaped to slideably cooperate with first portion 114 of mount clip 110. Clamp body 162 includes a first passage 176 and the second passage 178 that are each shaped to cooperate with a respective fastener 180, 1.82. When in an at rest or non-defamed configuration, a compression tolerance 184 is defined between mount clip 110 and respective portions 170, 172 associated with clamp body 162 such that first portion 114 of mount clip 110, loosely cooperates with compression slot 174 defined by clamp body 162.

Upon positioning of hand guard 42 and respective mount clip 110 proximate receiver 52, tightening of fasteners 180, 182 with respect of passages 176, 178 biases portions 170, 172 of clamp body 162 toward one another, as indicated by arrows 186, 188, and into contact engagement with first portion 114 of mount clip 110. Accordingly, mount clip 110 defines the minimal radial shape associated with receiver facing end 100 of hand guard 42 when fasteners 80, 82 are tightened into respective passages 176, 178 associated with clamp body 162. Said another way, mount clip 110 defines the maximum compression force associated with securing receiver facing end 100 of hand guard 42 about barrel nut 154. As fasteners 180, 182 are tightened, hand guard 42 achieves a compressive orientation relative to barrel nut 154 which is disposed radially inboard of the receiver facing end 100 of hand guard 42. The compression force is preferably selected to prevent translation of hand guard 42 relative to receiver 52 in at least the longitudinal or axial direction generally defined by the bore of firearm 40. The compression force also preferably limits rotational translation of hand guard 42 relative to receiver 52 or minimally increases the force required to effectuate such translation.

Figure 14:
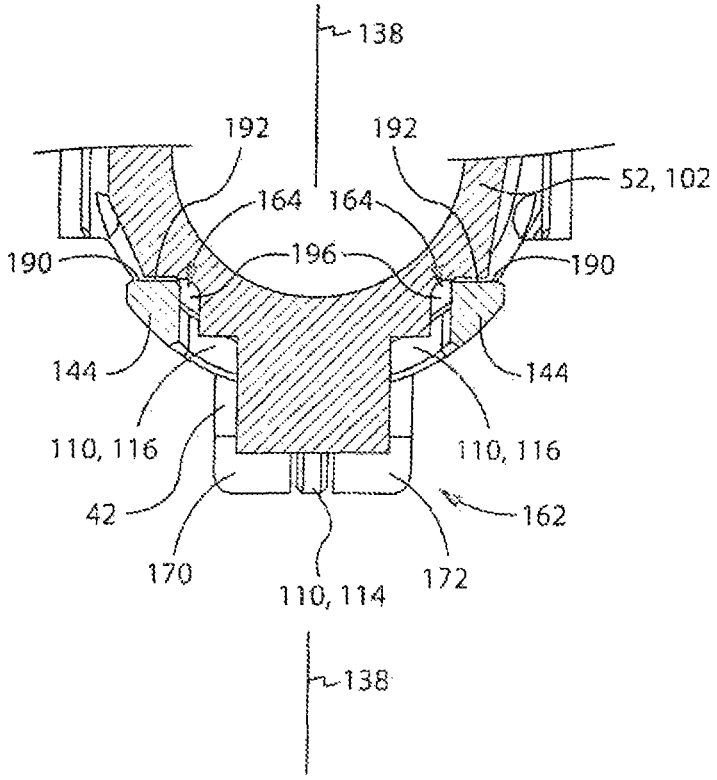
FIG. 14 is a cross-section elevation view of a portion of the assembly shown in FIG. 9 taken along line 14-14 shown in FIG. 10.

Referring to FIG. 14, when loosely associated and securely connected, projections 144 associated with second portion 116 of mount clip 110 nest within cavities 164 formed proximate forward facing end 102 of receiver 52 such that a top surface 190 associated with each projection 144 abuts a downward facing surface 192 associated with each respective cavity 164 defined by receiver 52. The cooperation of projections 144 with respective cavities 164 on generally opposite lateral sides associated with geometric plane 138 prevents rotation of mount clip 110 relative to receiver 52 and thereby prevents rotation of hand guard 42 relative to mount clip 110, as well as receiver 52. During assembly, barrel 48 and/or barrel nut 154 are secured to receiver 52 and hand guard 42 is positioned so that receiver facing end 100 of hand guard 42 is positioned in securable proximity to the forward facing end 102 of receiver 52. Mount clip 110 is introduced to the assembly such that first portion 114 of mount clip is disposed in compression slot 174 defined by hand guard 42 and projections 144 are disposed in cavities 164 defined by receiver 52.

When mount clip 110 is oriented in such a manner relative to hand guard 42 and receiver 52, a forward facing surface 194 (FIGS. 2 and 4) associated with one or more of projections 144, achieves an interference engagement with a receiver facing surface 196 (FIG. 14) associated with barrel 48 and/or barrel nut 154. The positional interfering engagement between projections 144 and barrel 48 and/or barrel nut 154 allows projections 144 to further act to prevent forward or muzzle directed axial translation of mount clip 110, and the hand guard 42 associated therewith, relative to receiver 52 when at least one fastener 180, 182 (FIG. 13) is associated with a respective passage 176, 178 of hand guard 42 and a corresponding opening 122, 124 associated with first portion 114 of mount clip 110. Such a construction provides a cooperation between the hand guard 42, receiver 52, and mount clip 110 that prevents rotational and longitudinal translation of the hand guard 42 relative to the receiver 52 even when just one fastener 180, 182 is associated with a respective passages 176, 178 defined by hand guard 42. It is further appreciated that the functionality associated with the construction associated with cooperation of first and second portions 114, 116 of mount clip 110 relative to hand guard 42 and receiver 52 could alternatively be reversed with respect to the construction of the respective facing ends of hand guard 42 and receiver 52.

When assembled, mounting arrangement 47 prevents longitudinal or axial translation, as well as rotational translation, of hand guard 42 relative to receiver 52, thereby providing a robust, secure, and mechanically sound platform configured to support various accessories relative to the underlying firearm via a selective engagement of such accessories with hand guard 42. Further, mount clip 110 and clamp body 162 cooperate in manner that defines a minimal radial shape or orientation associated with receiver facing end 100 of hand guard 42 and thereby prevents over compression of the hand guard 42 relative to the radially internally oriented structures associated with barrel 48, barrel nut 154, and/or a forward facing end of receiver 52. It should be further appreciated that mount clip 110 indexes hand guard 42 relative to receiver 52 during assembly so as to further provide an intuitive orientation of the hand guard relative to the receiver to facilitate and improve the ease of assembly associated with the same.

It is further appreciated that although projections 144 are shown as cooperating with cavities defined by receiver 52, it is further appreciated that mount clip 110 can be constructed to cooperate with barrel 48 and/or barrel nut 154 in a similar spatially interfering manner so as to selectively interfere with rotational translation of the hand guard 42 relative to receiver 52. That is, it is appreciated that the compression force defined by mount clip 110 and associated with securing hand guard 42 to the underlying firearm 40 can be effectuated between the hand guard 42 and one or more of the barrel 48, the barrel nut 154, or a forward facing end of the underlying receiver 52 as the construction and cooperation of such structures various across calipers, manufactures, etc. It is further appreciated that the rotation locking interaction between mount clip 110 and a respective firearm can be defined by cooperation of the mount clip 110 with any of the structures and for reasons similar to those identified above.

Figure 15:
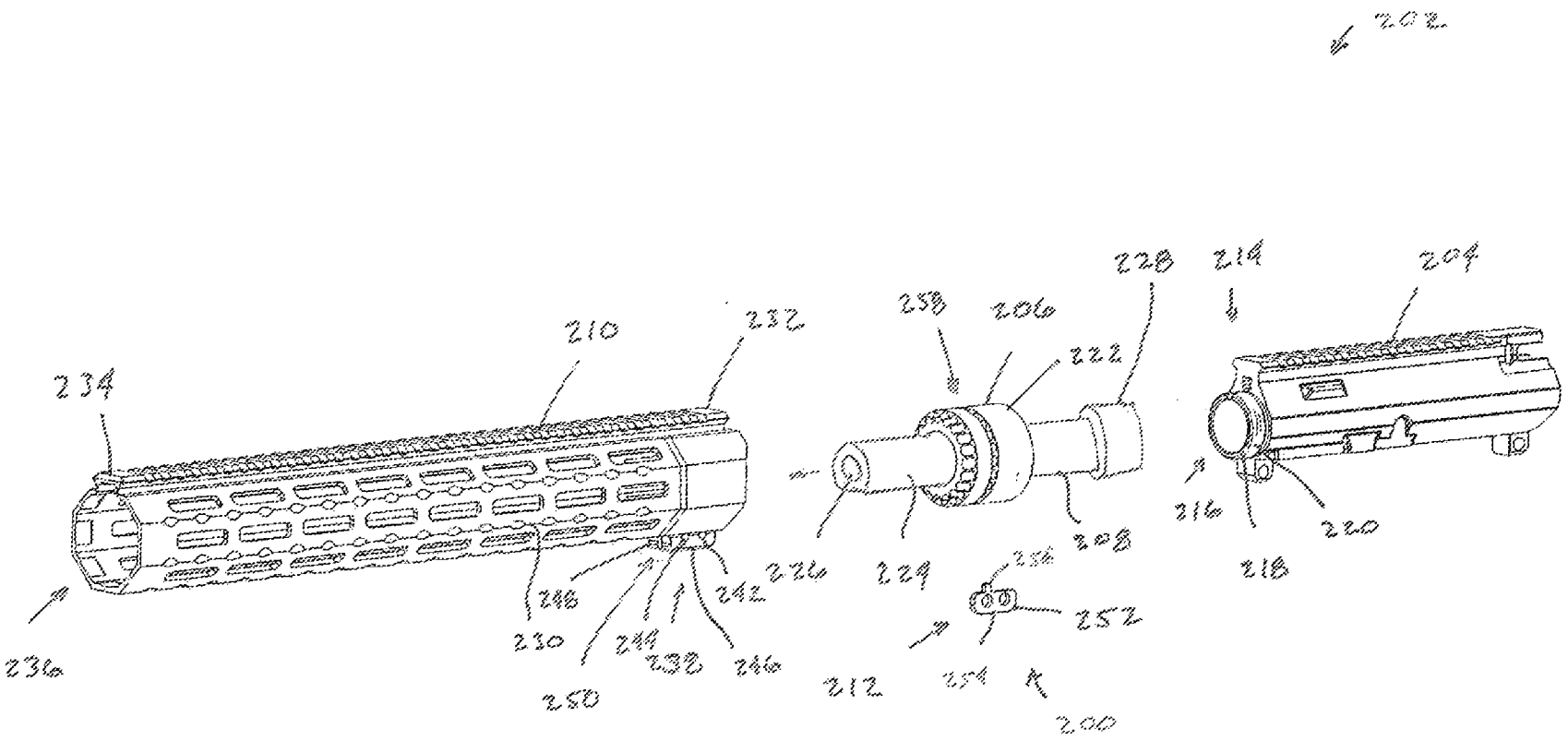
FIG. 15 is a view similar to FIG. 8 of perspective view of a portion of a firearm assembly having a hand guard mounting assembly according to another embodiment of the invention.

FIG. 15 shows a partially exploded view of a portion of a firearm assembly having a hand guard mounting arrangement 200 according to an alternate embodiment of the invention. It should be appreciated that the portion of the firearm assembly 202 shown in FIG. 15 can be utilized to generate a firearm assembly similar to that shown in FIG. 1 when fully assembled. The firearm assembly 202 includes an upper receiver portion or receiver 204, a barrel nut 206, a barrel 208, a hand guard assembly or hand guard 210 and a hand guard mounting or mount clip 212. A forward, hand guard, or barrel facing end 214 of receiver 204 includes a cavity 216 generally defined by a barrel mounting structure 218 defined by receiver 204. An exterior surface 220 of mounting structure 218 is constructed to cooperate with a receiver facing portion 222 of barrel nut 206. Barrel 208 is defined by a generally elongate body 224 that defines a bore 226 of firearm assembly 202 and that extends between a receiver facing end 228 and a muzzle not shown) at an opposite end thereof.

Receiver facing end 228 of barrel 208 is constructed to removably cooperate with cavity 216 associated with barrel or forward facing end 214 of receiver 204. Barrel nut 206 slideably cooperates with a majority of the body 224 of barrel 208 and rotationally cooperates with mounting structure 218 of receiver 204 so as to selectively secure barrel 208 relative thereto. Hand guard 210 is generally defined by a body 230 that extends from a receiver facing end 232 to a muzzle facing end 234 of hand guard 210. It is appreciated that hand guard 210 can be formed as a single body, or as multiple connected components. Like firearm 40, hand guard 210 defines a cavity 236 and is shaped to extend in a longitudinal direction along a majority of the longitudinal length associated with barrel 208.

Receiver facing end 232 of hand guard 210 includes a clamp body 238 that is substantially similar to or the same as clamp body 162 of hand guard 42. Like clamp body 162 as previously described, clamp body 238 is compressible for securing receiver facing end 232 of hand guard 210 relative to forward facing end 214 of receiver 204 when firearm assembly 202 is assembled. Clamp body 238 includes one or more openings 240, 242 that are constructed to receive fasteners as described above with respect to clamp body 162 so as to compress receiver facing end 232 of band guard 210 about barrel nut 206 and thereby secure receiver facing end 232 of hand guard 210 relative to receiver 204 when firearm assembly 202 is assembled.

Clamp body 238 includes respective first and second portions 246, 248 that define a gap or slot 250 therebetween. Mounting or mount clip 212 is defined by a body 252 that includes a first portion 254 and a second portion 256. As disclosed further below, body 252 of mount clip 212 is constructed to be disposed in slot 250 associated with clamp body 238 of hand guard 210. When disposed therein and associated with the underlying firearm assembly 202, first portion 254 of mount clip 212 is disposed between the respective portions 246, 248 of clamp body 238 and defines a minimum circumferential shape associated with clamp body 238 and second portion 256 of mount clip 212 cooperates with a channel or groove 258 defined by barrel nut 206 when firearm assembly 202 is assembled.

Figure 16:
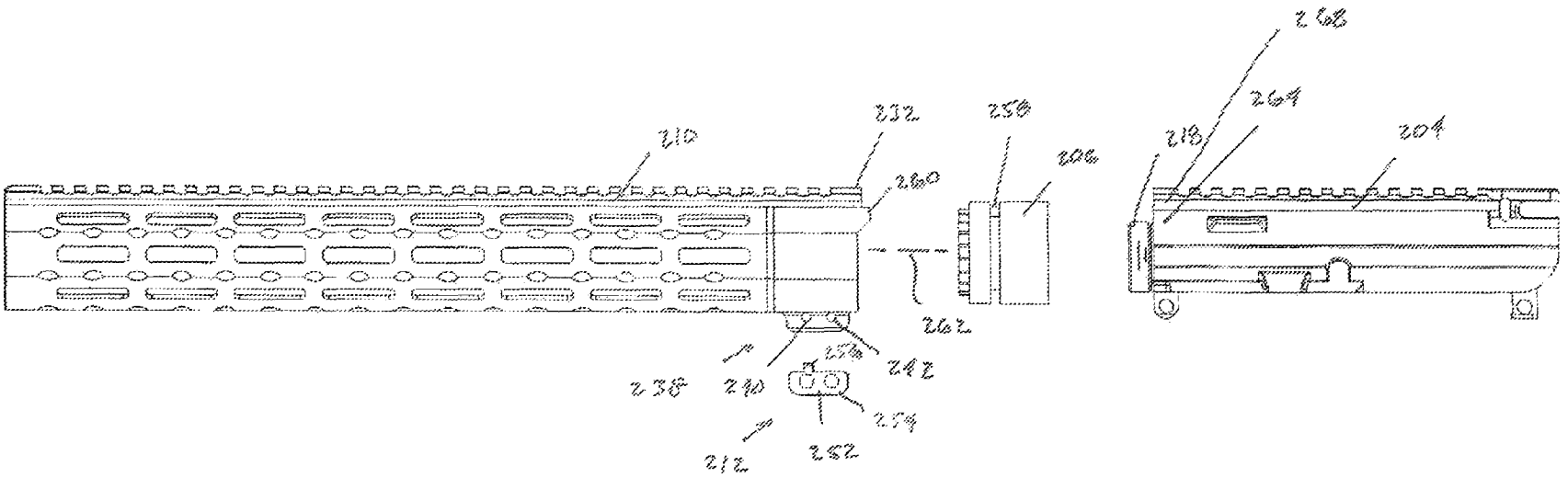
FIG. 16 is a side elevation view of the assembly shown in FIG. 15.
Figure 22:
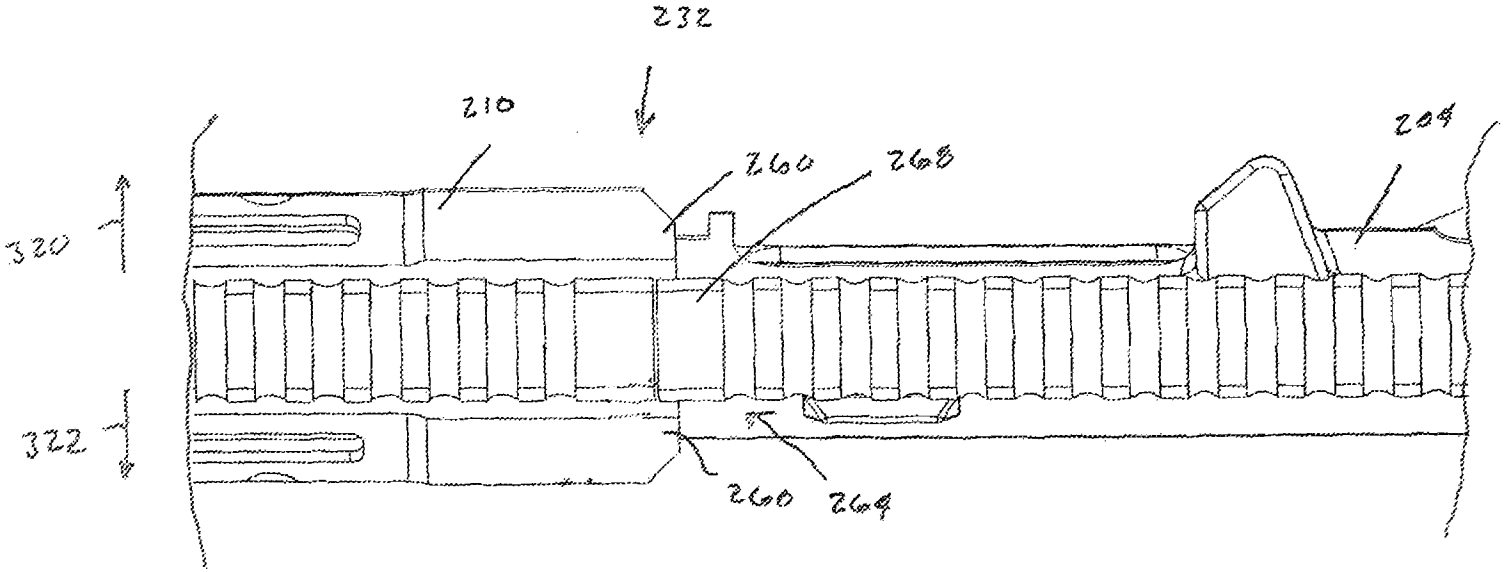
FIG. 22 is a top plan view of the receiver and hand guard assembly shown in FIGS. 15.

Referring to FIGS. 16 and 22, receiver facing end 232 of hand guard 210 includes one or more projections 260 that extend in a direction generally aligned with a longitudinal axis, indicated by line 262, of receiver 204, barrel 208, and hand guard 210. As shown in FIG. 22, when assembled, projections 260 generally overly a portion of a forward facing end 264 of receiver 204. As shown in FIG. 22, the right and left hand lateral sides of hand guard 210 each include a projection 260 which can slideably cooperate with forward facing end 264 of receiver 204 such that, when assembled, projections 260 generally flank a portion of a rail associated with projection 268 or other noncircular cross-sectional portion of forward facing end 264 of receiver 204. When assembled, the flanking association of projections, 260 of hand guard 210 with rail projection 268 of receiver 204 prevent rotation of hand guard 210 relative to receiver 204. It is appreciated that other interfering shapes can be provided between receiver 204 and hand guard 210 that prevent relative rotation therebetween. For instance, hand guard 210 can be configured to include a single projection that cooperates with a pair of projections associated with receiver 204 to negate any rotation therebetween. It is appreciated that other interfering or overlapping shapes can be provided between receiver and hand guard 210.

Figure 17:
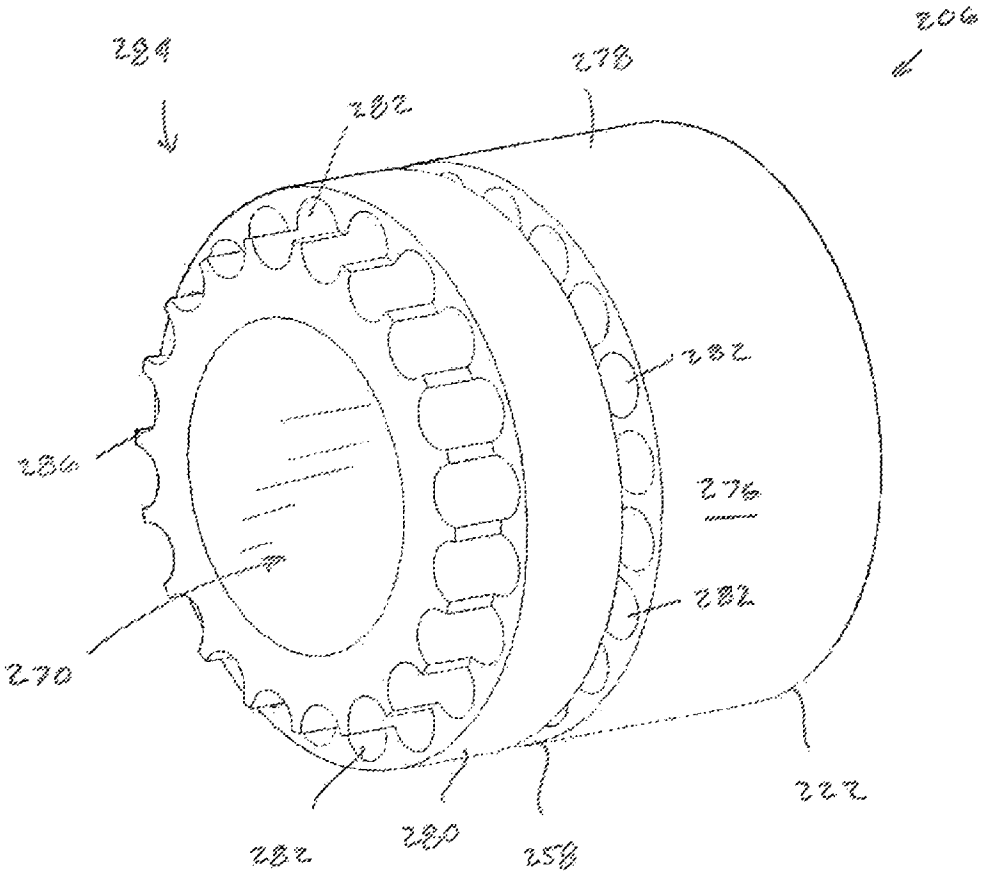
FIG. 17 is a forward oriented perspective view of a barrel nut associated with the portion of the firearm assembly shown in FIG. 15.
Figure 18:
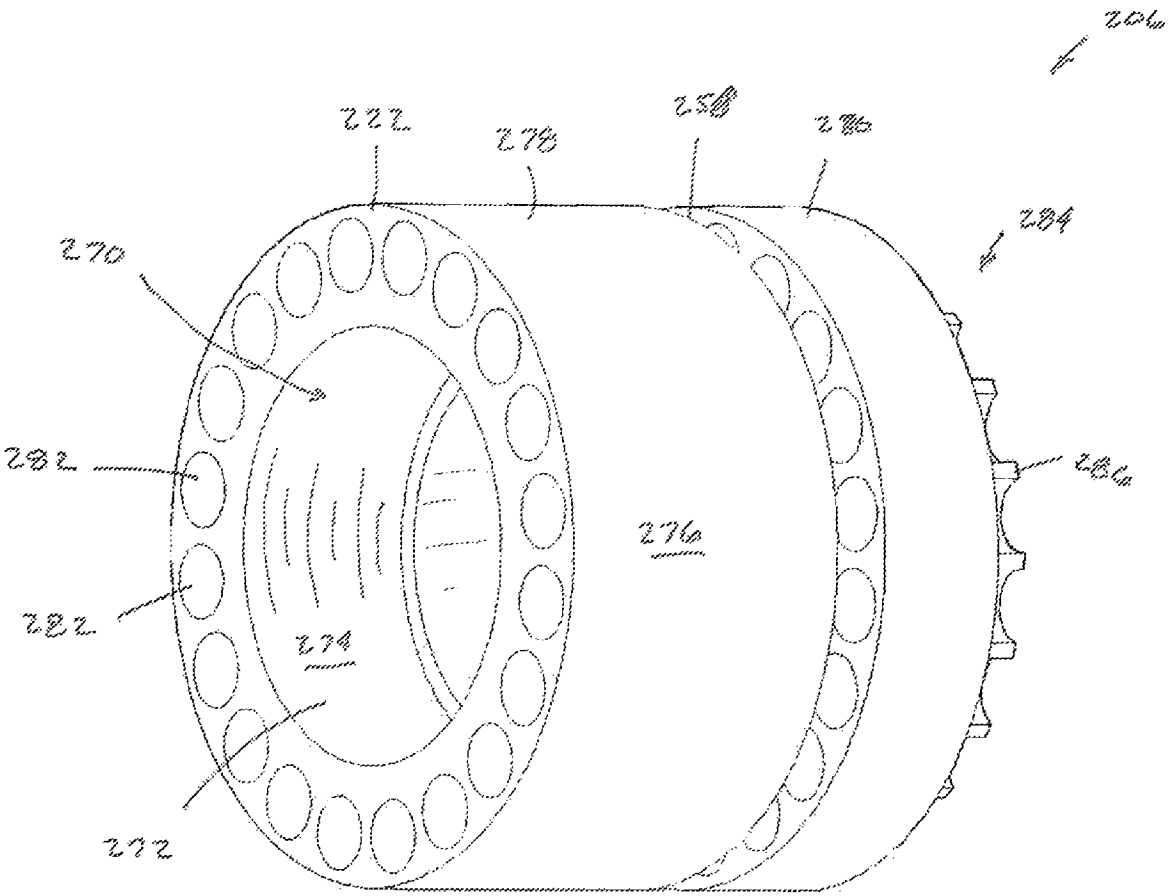
FIG. 18 is a rearward oriented perspective view of the barrel nut shown in FIG. 17.
Figure 19:
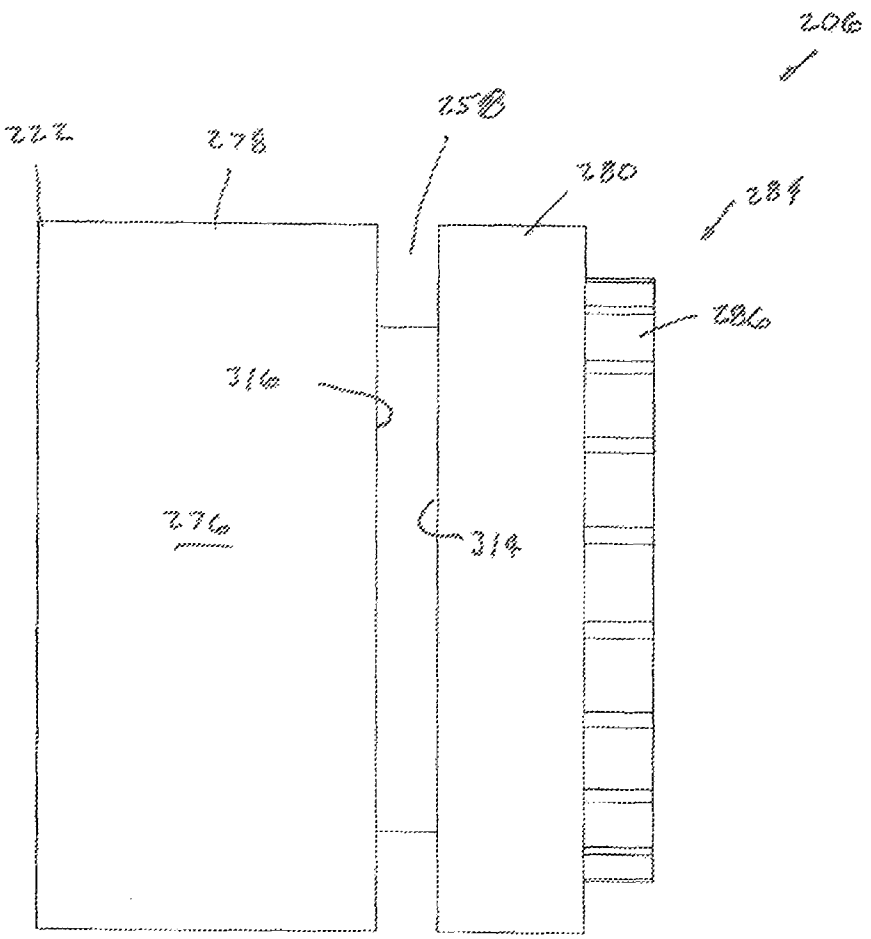
FIG. 19 is a lateral side elevation view of the barrel nut shown in FIGS. 17 and 18.

Referring to FIGS. 17-19, barrel nut 206 includes a passage 270 that is constructed to slideably cooperate with the elongated shape of barrel 208. A receiver facing portion 272 of passage 270 includes a threaded surface 274 that rotationally cooperates with threaded exterior surface 220 of receiver 204. Barrel nut 206 is defined by a body 276 that includes groove 258 formed therein. Groove 258 is fluidly isolated from passage 270 and disposed between a receiver facing portion 278 and a muzzle facing portion 280 of barrel nut 206, it is appreciated that groove 258 could be disposed at any location along the longitudinal exterior surface of barrel nut 206.

Barrel nut 206 includes one or more passage, 282 that each extend axially about a radially outer portion of body 276 and are circumferentially spaced relative to one another. Passages 282 are configured to facilitate cooling of barrel nut 206. A muzzle facing end 284 of barrel nut 206 defines a contour 286 configured to cooperate with a tool, such as a spanner or barrel nut wrench utilized to facilitate the rotational cooperation of barrel nut 206 with barrel mounting structure 218 of receiver 204. It should be appreciated from FIGS. 17-19 that a portion of passages 282 facilitate the shape of contour 286 for cooperation with a corresponding tool. It is appreciated that contour 286 can be provided in shapes other than that shown and configured for cooperation with a corresponding tool associated with the engagement and/or removal of barrel nut 206 from barrel mounting structure 218 defined by receiver 204 when barrel 208 extends through passage 270 defined by a body 276 of barrel nut 206.

Groove 258 extends about a circumference of body 276 and is configured to slideably cooperate with second portion 256 of mount clip 212 during assembly of firearm assembly 202. Although shown as extending about and entirety of the circumference of barrel nut 206, it is appreciated that groove 258 could be formed in only a respective radial portion of barrel nut 206 and configured to be oriented in a generally downward facing direction relative to firearm assembly 202 when barrel nut 206 is fully engaged with barrel mounting structure 218 of receiver 204. It should be appreciated that, when provided in such a configuration, groove 258 preferably extends a circumferential radial distance sufficient to be oriented in a generally downward facing direction so as to not prevent cooperation of second portion 256 of mount clip 212 with barrel nut 206 during subsequent assembly of firearm assembly 202.

Figure 20:
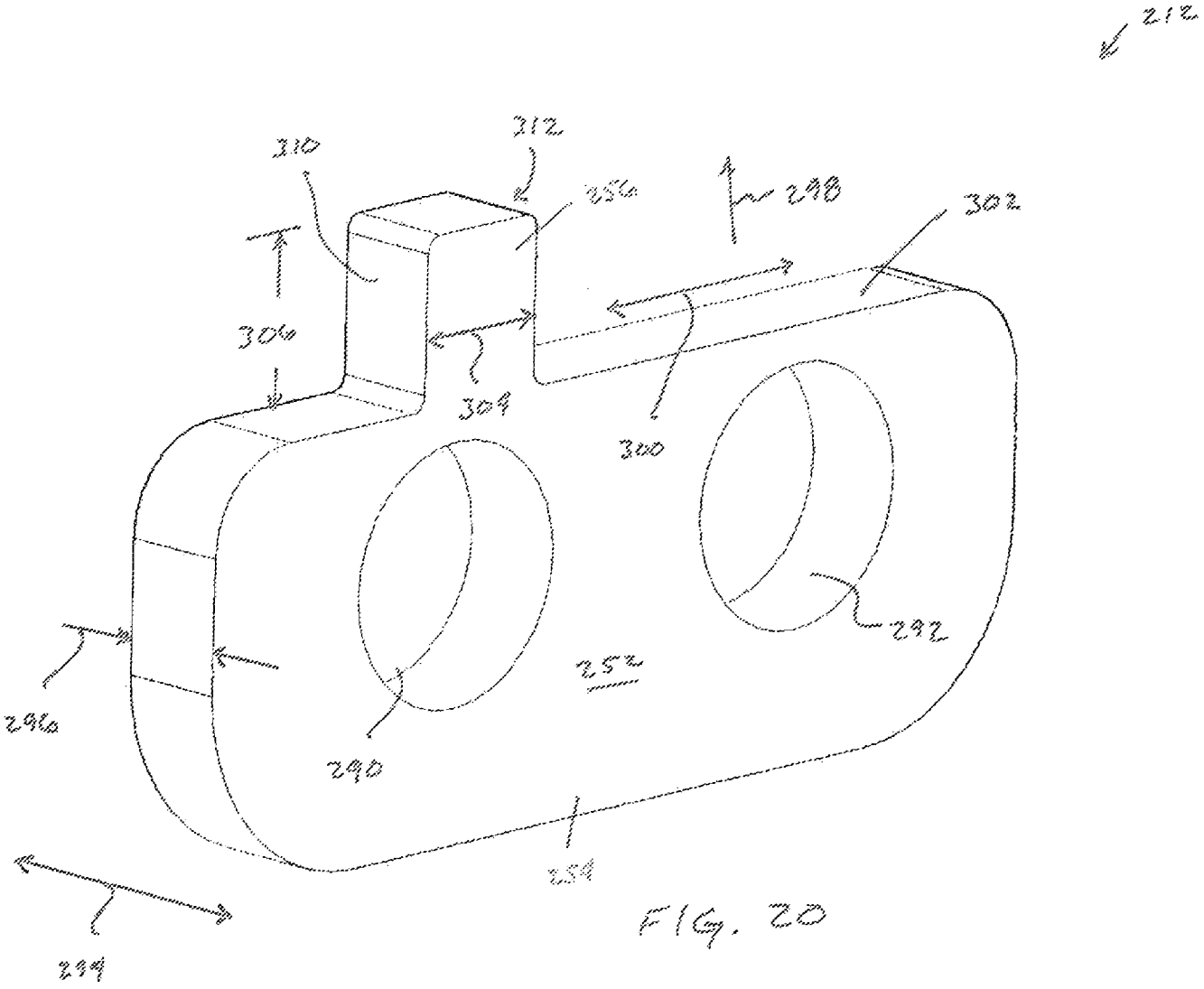
FIG. 20 is a forward oriented perspective view of a hand guard mounting clip associated with the firearm assembly shown in FIG. 15.

Referring to FIG. 20, first portion 254 of body 252 of mount clip 212 includes a first opening 290 and a second open 292 that each extend through body 252 in a generally lateral direction, indicated by arrow 294, relative thereto. Openings 290, 292 are configured to slideably receive a respective fastener associated with securing hand guard 210 relative to receiver 204 as described further below with respect to FIG. 23. Body 252 of mount clip 212 is generally defined by a width, indicated by dimension arrow, 296. Width 296 is associated with defining a maximum compression associated with receiver facing end 232 of hand guard 210 during tightening of the respective fasteners in the same manner as described above with respect to firearm 40.

Second portion 256 of body 252 of mount clip 212 extends in a generally outward radial direction, indicated by arrow 298, relative to first portion 254 of body 252. Said in another way, second portion 256 of body 252 of mount clip 212 extends in an outward radial direction relative to first portion 254 of body 252 and such that first and second portions 254, 256 of mount clip 212 are oriented in a common plane. Second portion 256 of body 252 extends in a longitudinal direction, indicated by arrow 300, relative to a top surface 302 of first portion 254 and defined by a length, indicated by arrow 304, and a height, indicated by arrow 306, such that second portion 256 of body 252 of mount clip 212 is disposed in groove 258 of barrel nut 206 during assembly of firearm assembly 202. As explained further below, second portion 256 of body 252 of mount clip 212 includes a forward oriented surface 310 and a rearward oriented surface 312 which are oriented to generally slideably cooperate with a respective receiver facing wall 314 and a muzzle facing wall or surface 316 (FIG. 19) associated with groove 258 when firearm assembly 202 is assembled and such that respective fasteners can pass through respective openings 290, 292.

Figure 21:
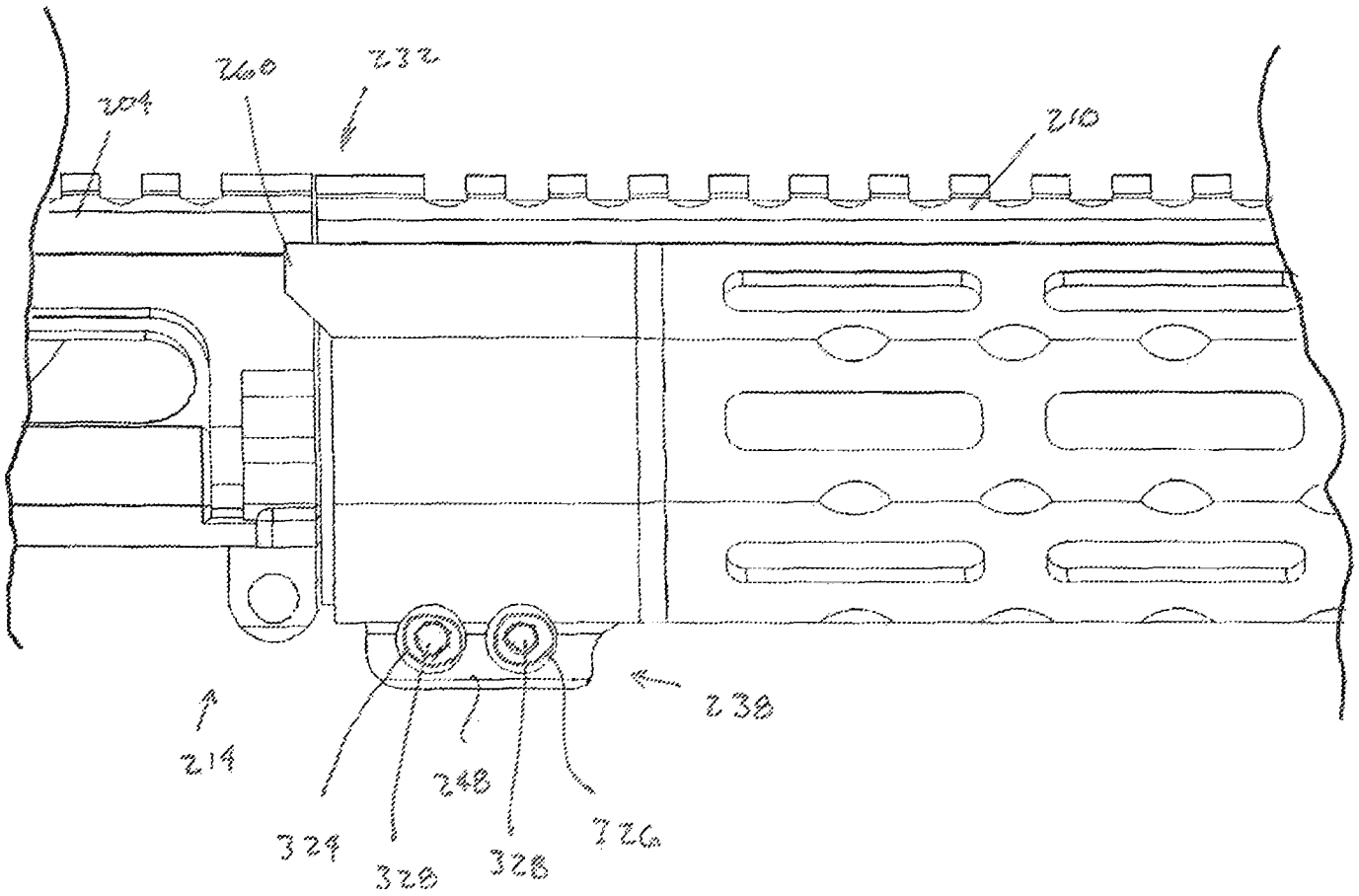
FIG. 21 is a side elevation view similar to FIG. 10 of a portion of the assembly shown in FIG. 15.
Figure 23:
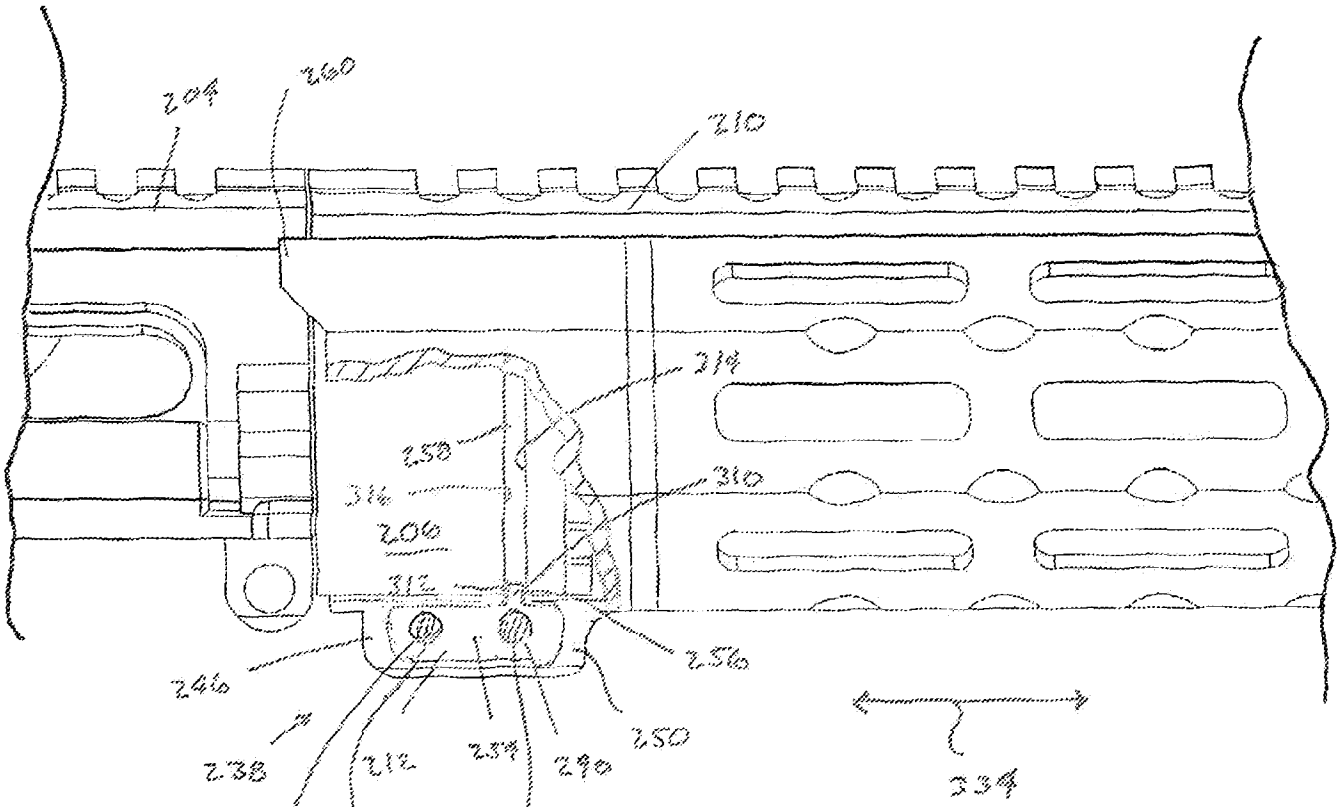
FIG. 23 is a view similar to FIG. 21 with a portion of the hand guard cut away and exposing the hand guard mount clip associated with the barrel nut of the assembly shown in FIG. 15.

Referring to FIGS. 21-23, upon securing of barrel 208 to receiver 204, via rotational engagement of barrel nut 206 with receiver 204, hand guard 210 is positioned relative to receiver 204 via longitudinal translation of hand guard 210 relative to longitudinal axis 262 associated with the bore of firearm assembly 202 until receiver facing end 232 of hand guard 210 is positioned in close or abutting proximity relative to hand guard or forward facing end 214 of receiver 204. Referring to FIG. 22, when oriented in such a position, alternate projections 260 associated with alternate lateral sides, indicated by arrows 320, 322 of receiver facing end 232 of hand guard 210 generally flank projection 268 of receiver 204 thereby preventing rotation of hand guard 210 relative to receiver 204. It is appreciated that the overlapping association between projections 260 of hand guard 210 and projection 268 associated with receiver 204 could be provided in a number of different manners. Regardless of the specific configuration associated with the overlapping arrangement, the generally loose positioning of hand guard 210 relative to receiver 204 prevents relative rotation between the hand guard 210 and receiver 204. Having loosely positioned hand guard 210 relative to receiver 204, mount clip 212 is associated with slot 250 of clamp body 238 of hand guard 210 such that first portion 254 of mount clip 212 is oriented between the respective portions 246, 248 of clamp body 238 such that openings 290, 292 of mount clip 212 are oriented to receive respective fasteners 324, 326 associated with biasing clamp body 238 to a smallest circumferential configuration via the manipulation of fasteners 324, 326. Each fastener 324, 326 includes a driver arrangement 328 configured for cooperation with a drive tool to facilitate tightening of clamp body 238.

As shown in FIG. 23, when mount clip 212 is associated with clamp body 238 such that fasteners 324, 326 cooperate with the openings 290, 292 associated therewith, second portion 256 of mount clip 212 is disposed in groove 258 associated with barrel nut 206 such that the forward and rearward facing surfaces 310, 312 of mount clip 212 cooperate with respective surfaces 314, 316 associated with groove 258 of barrel nut 206. Even when loosely oriented in such a configuration, it should be appreciated that the cooperation of second portion 256 of mount clip 212, with groove 258 of barrel nut 206 prevents longitudinal translation, indicated by arrow 334, of hand guard 210 relative to receiver 204 via the secure mechanical cooperation of barrel nut 206 with receiver 204 and the interference engagement between second portion 256 of mount clip 212 and barrel nut 206. As such, even a loose positional association of mounting clip 212 with the hand guard 210, barrel nut 206, and receiver 204 prevents both rotational and longitudinal translation of the hand guard 210 relative to receiver 204. Mount clip 212 prevents over-tightening of the connection of hand guard 210 to receiver 204 and cooperates with the underlying firearm assembly 202 in a manner that prevents undesired rotational and longitudinal translation of the hand guard 210 relative to the firearm assembly.

Therefore, one embodiment of the invention includes a mount clip that is defined by a body that includes a first portion and a second portion. The first portion of the clip body is constructed to be received in a slot defined by a hand guard and define a smallest diameter associated with a receiver end of a hand guard. The second portion of the clip body radially indexes the mount clip and a hand guard relative to a receiver.

Another embodiment that is useable or combinable with one of more of the features or aspects of the above embodiment includes a firearm assembly having a barrel and a receiver constructed to support the barrel. The firearm assembly includes a hand guard that extends longitudinally along a portion of the barrel. The hand guard includes a rearward facing end portion that is constructed to be compressed about a portion of one of the barrel or the receiver to secure the rearward facing end of the hand guard relative to a firearm. The assembly includes a clip that is configured to cooperate with the hand guard and define a preset compression associated with the rearward facing end portion of the hand guard when it is secured to one of the barrel or the receiver.

A further embodiment that is useable or combinable with one or more of the aspects or features of the above embodiments includes a method of forming a firearm hand guard mounting assembly for securing a hand guard that has at least one compression slot formed in a receiver facing end of the firearm hand guard. A clip is provided that cooperates with a compression slot defined by a receiver facing end of a hand guard. A portion of the clip has a thickness that defines a maximum deflection of the compression slot when the band guard is secured to a firearm.

A further embodiment that is useable or combinable with one or more of the aspects or features of the above embodiments includes a firearm hand guard mount assembly having a mount clip that is defined by a body that includes a first portion that is constructed to be received in a slot defined by a hand guard and define a smallest diameter associated with a receiver end of a hand guard. A second portion of the body is constructed to longitudinally index the mount clip and a hand guard relative to at least one of a barrel, a barrel nut, and a receiver.

Another embodiment that, is useable or combinable, with one of more of the features or aspects of the above embodiment includes a firearm assembly that includes a barrel and a receiver constructed to support the barrel. A hand guard that extends longitudinally along a portion of the barrel includes a rearward facing end portion that is constructed to be compressed about a portion of one of the barrel or the receiver to secure the rearward facing end of the hand guard relative to a firearm. The assembly includes a clip that is configured to cooperate with at least one of the barrel, a barrel nut, the receiver and the hand guard and define a preset compression associated with the rearward facing end portion of the hand guard when it is secured to one of the barrel, the barrel nut, and the receiver.

A further embodiment that is useable or combinable with one of more of the features or aspects of the above embodiment includes a method of securing a hand guard to a firearm. The method includes positioning a firearm hand guard and a torsion clip relative to a firearm receiver such that a first portion of the torsion clip interferingly cooperates with at least one of the firearm receiver, a barrel of the firearm, and a barrel nut associated with securing the barrel, to the firearm. At least one fastener that extends across a compression slot defined by a receiver facing end of the hand guard is tightened such that a second portion of the torsion clip defines a maximum deflection of the compression slot of the hand guard.

Another embodiment that is useable or combinable with one of more of the features or aspects of the above embodiment includes a firearm barrel nut that includes a body that defines a bore configured to cooperate with a barrel of a firearm. The body extends between a first end configured to be oriented nearer a muzzle of a barrel and a second end constructed to cooperate with a receiver. At least one of a projection and a recess are formed in an exterior surface of the body and configured to cooperate with a mount clip constructed to cooperate with a hand guard to create an interference engagement between the barrel nut and the clip that prevents longitudinal translation of the clip relative to the barrel nut.

The present invention has been described in terms of the preferred embodiment, the embodiment disclosed herein is directed to the assembly as generally shown in the drawings. It is recognized that equivalents, alternatives, and modifications, aside from those expressly stated, to the embodiments summarized, or the embodiment shown in the drawings, are possible and within the scope of the appending claims. The appending claims cover all such alternatives and equivalents.

What is claimed is:

1. A firearm hand guard mount assembly, the assembly comprising:

a mount clip that is defined by a body that includes a first portion having a single generally planar shape that is constructed to be received in a slot defined by a deformable clamp portion of a hand guard to define a smallest diameter associated with deformation of the deformable clamp portion associated with a receiver end of the hand guard and a second portion that is constructed to longitudinally index the mount clip and a hand guard relative to at least one of a barrel, a barrel nut, and a receiver.

2. The assembly of claim 1 further comprising a fastener constructed to cooperate with a hand guard proximate a slot defined by the hand guard and operable to manipulate a dimension associated with the slot.

3. The assembly of claim 1 wherein the first portion of the body of the mount clip includes at least one opening configured to cooperate with a fastener configured to cooperate with a hand guard proximate the slot.

4. The assembly of claim 1 wherein the second portion of the body extends from the first portion of the body in an outward radial direction relative to an imaginary plane defined by the first portion of the body such that the first portion of the body and the second portion of the body are oriented in a common plane.

5. The assembly of claim 4 wherein the second portion is further defined as an ear that is configured to engage at least one of a barrel and a barrel nut associated with a receiver of a fire arm.

6. The assembly of claim 5 wherein the first portion of the body further comprises a first opening and a second opening and the second portion of the body is oriented nearer the first opening than the second opening.

7. The assembly of claim 1 wherein the second portion of the body includes a first ear and a second ear that each extend in a respective opposite crossing directions relative to an imaginary center line plane of the first portion of the body and further comprises a tang associated with each of the first ear and the second ear.

8. The assembly of claim 1 wherein the body is bilaterally symmetric relative to a vertical plane that bisects the first portion of the body.

9. A firearm assembly comprising:

a barrel;

a receiver constructed to support the barrel;

a hand guard that extends longitudinally along a portion of the barrel and that includes a deformable rearward facing end portion that is constructed to be compressed about a portion of one of the barrel or the receiver to secure the rearward facing end of the hand guard relative to a firearm; and a clip configured to cooperate with at least one of the barrel, a barrel nut, the receiver and the hand guard and define a preset compression associated with deformation of the rearward facing end portion of the hand guard when it is secured to one of the barrel, the barrel nut, and the receiver.

10. The firearm assembly of claim 9 further comprising a slot formed in the rearward facing end portion of the hand guard that is shaped to loosely cooperate with at least a portion of the clip.

11. The firearm assembly of claim 10 further comprising at least one fastener configured to cooperate with the rearward facing end portion of the hand guard and traverse the slot and the portion of the clip associated therewith.

12. The firearm assembly of claim 11 further comprising an opening defined by the clip and configured to slideably cooperate with the at least one fastener.

13. The firearm assembly of claim 12 further comprising another opening that is defined by the clip, offset from the opening, and configured to slideably cooperate with another fastener configured to engage the rearward facing portion of the hand guard.

14. The firearm assembly of claim 9 further comprising at least one projection that extends from the clip and cooperates with at least one of the barrel, the barrel nut, and the receiver to prevent at least one of rotation of the hand guard about a longitudinal axis defined by the barrel and longitudinal translation of the hand guard relative to the at least one of the barrel, the barrel nut, and the receiver when the at least one projection is in cooperation with the at least one of the barrel, the barrel nut, and the receiver.

15. A method of securing a hand guard to a firearm, the method comprising:

positioning a firearm hand guard and a torsion clip relative to a firearm receiver such that a first portion of the torsion clip interferingly cooperates with at least one of the firearm receiver, a barrel of the firearm, and a barrel nut associated with securing the barrel to the firearm; and tightening at least one fastener that extends across a compression slot defined by a receiver facing end of the hand guard such that a second portion of the torsion clip defines a maximum deflection of the compression slot of the hand guard.

16. The method of claim 15 further comprising providing another fastener configured to cooperate with the hand guard proximate the receiver facing end and that traverses the compression slot in a direction aligned with the fastener such that the fastener and another fastener are generally parallel relative to one another and each extend in a direction that crosses an axis defined by a bore of the firearm.

17. The method of claim 16 further comprising seating a head portion of the fastener in a counter bore formed in the hand guard.

18. The method of claim 15 further comprising forming an opening in the clip that is shaped to slideably cooperate with the at least one fastener.

19. The method of claim 15 further comprising forming an indexer on the clip and at least one of shaping and orienting the indexer to cooperate with at least one of a projection and a recess formed in at least one of the barrel, the barrel nut, and the receiver to prevent longitudinal translation of the clip and the hand guard when the hand guard is secured to the receiver of a firearm.

20. The method of claim 15 further comprising providing various clips that are each individually configured to cooperate with at least one of a respective hand guard construction and at least one of a respective barrel construction, a respective barrel nut construction, and a respective receiver construction.

21. The method of claim 15 further comprising overlapping at least a portion of the firearm hand guard with the firearm receiver to prevent rotation of the firearm hand guard relative to the firearm receiver when assembled.

22. A firearm assembly comprising:

a barrel nut defined by a body that defines a bore configured to cooperate with a barrel of a firearm, the body extending between a first end configured to be oriented nearer a muzzle of a barrel and a second end constructed to cooperate with a receiver;

at least one of a projection and a recess formed in an exterior surface of the body of the barrel nut; and a mount clip having a generally planar shape that extends in a longitudinal direction generally aligned with the barrel of the firearm and includes a first portion that is configured to cooperate with a slot defined by a deformable clamp of a hand guard and a second portion that interferingly cooperates with the at least one of the projection and the recess formed in the exterior surface of the body of the barrel nut such that the mount clip prevents translation of the hand guard relative to the barrel nut when the deformable clamp is compressed about the first portion of the mount clip.

23. A firearm hand guard mount assembly, the assembly comprising:

a mount clip that is defined by a body that includes a first portion that is generally planar and constructed to be received in a slot defined by a hand guard and define a smallest diameter associated with a receiver end of a hand guard and a second portion that is constructed to longitudinally index the mount clip and a hand guard relative to at least one of a barrel, a barrel nut, and a receiver; and wherein the second portion of the body extends from the first portion of the body in an outward radial direction relative to an imaginary plane defined by the first portion of the body such that the first portion of the body and the second portion of the body are oriented in a common plane.

* * * * *